US009089845B2

(12) United States Patent
Motadel et al.

(10) Patent No.: US 9,089,845 B2
(45) **Date of Patent: *Jul. 28, 2015**

(54) ANTI-STATIC PIPETTE TIP TRAYS

(71) Applicant: BIOTIX, INC., San Diego, CA (US)

(72) Inventors: Arta Motadel, San Diego, CA (US); Scott Edward Curry, San Marcos, CA (US)

(73) Assignee: BIOTIX, INC., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/769,212

(22) Filed: Feb. 15, 2013

(65) Prior Publication Data

US 2013/0161226 A1 Jun. 27, 2013

Related U.S. Application Data

(63) Continuation of application No. 12/692,426, filed on Jan. 22, 2010, now Pat. No. 8,470,265.

(60) Provisional application No. 61/147,065, filed on Jan. 23, 2009.

(51) Int. Cl.

| | |
|---|---|
| ***B01L 3/02*** | (2006.01) |
| ***B01L 9/00*** | (2006.01) |
| ***B65D 85/00*** | (2006.01) |

(52) U.S. Cl.

CPC ..... *B01L 9/543* (2013.01); *B65D 85/00* (2013.01); *B01L 2300/0829* (2013.01); *B01L 2300/12* (2013.01); *B01L 2300/14* (2013.01)

(58) Field of Classification Search

CPC ..... B01L 9/543; B65D 85/00
USPC ..... 422/524–526, 501, 509–511, 933; 206/47–78, 484.2, 485, 486, 557, 525

See application file for complete search history.

(56) References Cited

U.S. PATENT DOCUMENTS

| | | | |
|---|---|---|---|
| D246,466 | S | 11/1977 | Attree et al. |
| 4,130,978 | A | 12/1978 | Cohen |
| D264,810 | S | 6/1982 | Voltmann |
| 4,349,109 | A | 9/1982 | Scordato et al. |
| D271,239 | S | 11/1983 | Lemieux et al. |
| D282,208 | S | 1/1986 | Lowry |
| D283,162 | S | 3/1986 | Godsey |
| 4,577,760 | A | 3/1986 | Rainin et al. |

(Continued)

FOREIGN PATENT DOCUMENTS

| | | |
|---|---|---|
| EP | 1110613 | 6/2001 |
| WO | WO 95/08392 | 3/1995 |

(Continued)

OTHER PUBLICATIONS

International Search Report and Written Opinion mailed on: Sep. 2, 2010 in International Application No. PCT/US2010/021838 filed on Jan. 22, 2010 and published as: WO 10/085669 on: Jul. 29, 2010.

(Continued)

*Primary Examiner* — Brian R Gordon
(74) *Attorney, Agent, or Firm* — Grant IP, Inc.

(57) ABSTRACT

Provided herein are anti-static pipette trays that reduce the amount of static charge accumulated on or in pipette tips and allow for discharge of any accumulated static charge.

14 Claims, 11 Drawing Sheets

(56) References Cited

U.S. PATENT DOCUMENTS

| | | | |
|---|---|---|---|
| 4,676,377 | A | 6/1987 | Rainin et al. |
| 5,156,811 | A | 10/1992 | White |
| D332,145 | S | 12/1992 | Wada et al. |
| D337,165 | S | 7/1993 | Malinoff |
| 5,255,979 | A | 10/1993 | Ferrari |
| 5,366,088 | A | 11/1994 | Hill et al. |
| 5,392,914 | A | 2/1995 | Lemieux et al. |
| 5,487,872 | A | 1/1996 | Hafeman et al. |
| 5,612,000 | A | 3/1997 | Lemieux |
| 5,882,603 | A | 3/1999 | Taggart |
| D411,308 | S | 6/1999 | Pandey et al. |
| D414,271 | S | 9/1999 | Mendoza |
| 6,007,779 | A | 12/1999 | Lemieux et al. |
| D420,142 | S | 2/2000 | Ballin et al. |
| D420,743 | S | 2/2000 | Monks |
| 6,019,225 | A | 2/2000 | Kalmakis et al. |
| 6,164,449 | A | 12/2000 | Lahti |
| D439,673 | S | 3/2001 | Brophy et al. |
| D441,091 | S | 4/2001 | Day |
| 6,286,678 | B1 | 9/2001 | Petrek |
| D448,854 | S | 10/2001 | Kuiper et al. |
| D452,740 | S | 1/2002 | Brennan et al. |
| 6,426,047 | B1 | 7/2002 | Hamel et al. |
| D461,554 | S | 8/2002 | Lafond et al. |
| D464,734 | S | 10/2002 | Berna et al. |
| D466,219 | S | 11/2002 | Wynschenk et al. |
| 6,517,782 | B1 | 2/2003 | Horner et al. |
| 6,875,405 | B1 | 4/2005 | Mathus et al. |
| 7,060,226 | B1 | 6/2006 | Jessop et al. |
| D529,622 | S | 10/2006 | Hadjis et al. |
| D533,948 | S | 12/2006 | Schaub et al. |
| D534,658 | S | 1/2007 | Bargh |
| 7,169,361 | B2 | 1/2007 | Arnold et al. |
| 7,220,590 | B2 | 5/2007 | Moritz et al. |
| D556,338 | S | 11/2007 | Coulling et al. |
| D556,339 | S | 11/2007 | Coulling et al. |
| D562,463 | S | 2/2008 | Berndt et al. |
| 7,335,337 | B1 | 2/2008 | Smith |
| D574,505 | S | 8/2008 | Muller-Cohn et al. |
| D576,208 | S | 9/2008 | Quercetti |
| D593,207 | S | 5/2009 | Ayliffe |
| D598,566 | S | 8/2009 | Allaer |
| 7,628,960 | B2 | 12/2009 | Ruddock |
| D608,013 | S | 1/2010 | Coulling et al. |
| D632,404 | S | 2/2011 | Karpiloff |
| 7,906,075 | B2 | 3/2011 | Ueda |
| 7,968,056 | B2 | 6/2011 | Stockwell |
| D654,186 | S | 2/2012 | Park et al. |
| D657,473 | S | 4/2012 | Miyashita et al. |
| 8,148,168 | B2 | 4/2012 | Gjerde et al. |
| 2003/0064508 | A1 | 4/2003 | Kwasnoski et al. |
| 2003/0152494 | A1 | 8/2003 | Moritz et al. |
| 2006/0093530 | A1 | 5/2006 | Ueda |
| 2007/0017870 | A1 | 1/2007 | Belov et al. |

FOREIGN PATENT DOCUMENTS

| | | |
|---|---|---|
| WO | WO 00/24513 | 5/2000 |
| WO | WO 01/70401 | 9/2001 |
| WO | WO 02/072261 | 9/2002 |
| WO | WO 03/064271 | 8/2003 |
| WO | WO 2006/133440 | 12/2006 |
| WO | WO 2009/126945 | 10/2009 |
| WO | WO 2010/085669 | 7/2010 |

OTHER PUBLICATIONS

International Preliminary Report on Patentability mailed on: Aug. 4, 2011 in International Application No. PCT/US2010/021838 filed on Jan. 22, 2010 and published as: WO 10/085669 on: Jul. 29, 2010.

Extended European Search Report dated: Jun. 1, 2012 in European Application No. EP10733922 filed Jan. 22, 2010, based on International Application No. PCT/US2010/021838 filed Jan. 22, 2010 and published as WO/2010/085669 on Jul. 29, 2010.

Office Action mailed: Feb. 26, 2013 in U.S. Appl. No. 12/692,426, filed Jan. 22, 2012 and published as: US-2010/0221151 on: Sep. 2, 2010.

Office Action mailed: Sep. 25, 2012 in U.S. Appl. No. 12/692,426, filed Jan. 22, 2012 and published as: US-2010/0221151 on: Sep. 2, 2010.

Office Action mailed: Feb. 13, 2012 in U.S. Appl. No. 12/692,426, filed Jan. 22, 2012 and published as: US-2010/0221151 on: Sep. 2, 2010.

Office Action mailed: Apr. 26, 2012 in U.S. Appl. No. 29/354,397, filed Jan. 22, 2010.

Office Action mailed: Nov. 8, 2012 in U.S. Appl. No. 29/354,397, filed Jan. 22, 2010.

U.S. Appl. No. 61/044,243, filed Apr. 11, 2008 by Arta Motadel.

Office Action mailed on Jun. 25, 2013 in U.S. Appl. No. 29/445,143, filed Feb. 27, 2013.

Office Action mailed on Feb. 12, 2014 in U.S. Appl. No. 29/445,143, filed Feb. 27, 2013.

DETAIL A

Static readings performed without gloves of Biotix and Competitor's product

Static readings performed in latex gloves of Biotix and Competitor's product

Static readings performed in nitrile gloves of Biotix and Competitor's product

ANTI-STATIC PIPETTE TIP TRAYS

RELATED PATENT APPLICATIONS

This patent application is a continuation of U.S. patent application Ser. No. 12/692,426, filed on Jan. 22, 2010, entitled ANTI-STATIC PIPETTE TIP TRAYS, naming Arta Motadel et al. as inventors, and designated, which claims the benefit of U.S. provisional patent application No. 61/147,065 filed Jan. 23, 2009, entitled ANTI-STATIC PIPETTE TIP TRAYS, naming Arta Motadel as an inventor, and designated. The entire content of the foregoing patent applications is incorporated herein by reference, including all text, tables and drawings.

FIELD

The technology described herein relates in part to pipette tip trays that prevent and/or reduce static charge generation on pipette tips and facilitate static charge discharge, and methods for manufacturing and using the same.

BACKGROUND

Pipette tips are utilized in a variety of industries that have a requirement for handling fluids, and are used in facilities including medical laboratories and research laboratories, for example. Pipette tips often are cone-shaped with an aperture at one end that can engage a dispensing device, and another relatively smaller aperture at the other end that can receive and emit fluid. Pipette tips generally are manufactured from a moldable plastic, such as polypropylene, for example. Pipette tips can be utilized in conjunction with a variety of dispensing devices, including manual pipette devices and automated robotic dispensers.

Pipette tips often are provided in a pipette tip tray, which includes a substantially hollow rack body and a perforate card affixed to the top of the body. Pipette tips generally are inserted in apertures of the perforate card and are thereby arranged in an array. A pipette tip tray sometimes is provided with a lid that covers the pipette tips. A collection of pipette tip trays often is held in a container (e.g., a box container).

SUMMARY

Featured herein are pipette tip trays having a rack, a lid and pipette tips mounted in the rack, where (i) pipette tips are substantially immobilized, and (ii) pipette tips are in contact with an electrically conductive element in communication with the tray exterior. Also featured herein are pipette tip trays having a rack, a lid, a bottom and pipette tips mounted in the rack where (i) pipette tips are substantially immobilized, and (ii) pipette tips are in contact with an electrically conductive element in communication with the tray exterior. Also provided are pipette tip trays configured to allow a user to discharge electrostatic charge through the top and/or side of a tray. The pipette tip trays described herein have certain advantageous features that reduce or prevent the build-up of static charge in pipette tips contained therein. In some embodiments, a pipette tip tray comprises a bottom surface and/or enclosure.

Thus, provided herein is a pipette tip tray comprising a rack, lid and pipette tip components, where: (a) the rack comprises four sides and a top; (b) the top comprises apertures and the pipette tips are positioned in the apertures; (c) the lid is in connection with the rack; (d) the pipette tips are in contact with an electrically conductive member; (e) the electrically conductive member is in effective communication with the pipette tip tray exterior; and (f) the pipette tips are substantially immobilized.

Also provided is a pipette tip tray comprising rack, lid and pipette tip components, where: (a) the rack comprises four sides and a top; (b) the top comprises apertures and the pipette tips are positioned in the apertures; (c) the lid is in connection with the rack; (d) the lid comprises (i) an electrically conductive member in effective communication with the pipette tip tray exterior, and (ii) a pliant member between the electrically conductive member and an interior surface of the lid; (e) the electrically conductive member is in contact with the pipette tips; and (f) the pliant member is deformed and applies pressure to the top of each of the pipette tips; whereby the pipette tips are substantially immobilized.

Provided also herein is a pipette tip tray comprising rack, lid and pipette tip components, where: (a) the rack comprises four sides and a top; (b) the top comprises apertures and the pipette tips are positioned in the apertures; (c) the lid is in connection with the rack; (d) the lid comprises an electrically conductive and pliant member in effective communication with the pipette tip tray exterior and in effective contact with an interior surface of the lid; (e) the electrically conductive and pliant member is in contact with the pipette tips; and (f) the electrically conductive and pliant member is deformed and applies pressure to the top of each of the pipette tips; whereby the pipette tips are substantially immobilized.

Also provided herein is a pipette tip tray comprising rack and lid components, where: (a) the rack comprises four sides and a top; (b) the top comprises apertures shaped to receive pipette tips; (c) the lid comprises an electrically conductive member that can contact pipette tips when they are positioned in the apertures; (d) the electrically conductive member is in effective communication with the pipette tip tray exterior; and (e) the lid comprises a pliant material in effective contact with pipette tips when they are positioned in the apertures.

Provided also herein is a method for discharging static electricity from pipette tips in a pipette tip tray, which comprises: (a) providing a pipette tip tray comprising rack, lid and pipette tip components, where: (i) the rack comprises four sides and a top; (ii) the top comprises apertures and the pipette tips are positioned in the apertures; (iii) the lid is in connection with the rack; the pipette tips are in contact with an electrically conductive member; (iv) the electrically conductive member is in effective communication with the pipette tip tray exterior; and (v) the pipette tips are substantially immobilized; and (b) contacting the electrically conductive member with an object at the pipette tip tray exterior, whereby the static electricity of the pipette tips in the pipette tip tray is discharged to the object.

Also provided herein is a pipette tip tray comprising a rack, lid and pipette tip components, where: (a) the rack comprises four sides and a top; (b) the top comprises apertures and the pipette tips are positioned in the apertures; (c) the lid is in connection with the rack; (d) the lid comprises an electrically conductive material; (e) the electrically conductive material is in effective communication with the pipette tip tray exterior; and (f) the pipette tips are substantially immobilized. In some embodiments, a portion of the bottom surface of the lid is in contact with substantially all of the pipette tips. The lid, in some embodiments, is conductive and static charge in pipette tips in contact with the lower surface of the lid can discharge through the thickness of the lid to the top surface of the lid. The lid may comprise two or more electrically conductive materials in some embodiments. In some embodiments, the lid consists essentially of an electrically conductive material. As used herein "consists essentially of an electrically conductive material" refers to a lid manufactured from an electrically conductive material and may include one or more other materials that are not electrically conductive and do not materially effect the conductivity of the conductive material. The lid, in some embodiments, comprises about 75% or more of an electrically conductive material (e.g., about 75, 76, 77, 78, 79, 80, 81, 82, 83, 84, 85, 86, 87, 88, 89, 90, 91, 92, 93, 94, 95, 96, 97, 98, 99 or about 99% or more electrically conductive material). The lid in certain embodiments consists of an electrically conductive material (e.g., one or more electrically conductive materials). In certain embodiments, a rack component can comprise an electrically conductive material (e.g., a plate or card). Also provided is a pipette tip tray comprising a rack, lid and pipette tip components, where: (a) the rack comprises four sides and a top; (b) the top comprises apertures into which pipette tips can be positioned; (c) the lid is in connection with the rack; (d) the lid comprises an electrically conductive material; (e) the electrically conductive material is in effective communication with the pipette tip tray exterior; and (f) the pipette tips can be substantially immobilized against the bottom surface of the lid.

Provided also herein is a method for discharging static electricity from pipette tips in a pipette tip tray, which comprises: (a) providing a pipette tip tray comprising rack, lid and pipette tip components, where: (i) the rack comprises four sides and a top; (ii) the top comprises apertures and the pipette tips are positioned in the apertures; (iii) the lid is in connection with the rack; (iv) the lid comprises an electrically conductive material; (v) the electrically conductive material is in effective communication with the pipette tip tray exterior; and (vi) the pipette tips are substantially immobilized; and (b) contacting the electrically conductive member with an object at the pipette tip tray exterior, whereby the static electricity of the pipette tips in the pipette tip tray is discharged to the object.

Certain embodiments are described further in the following description, claims and drawings.

BRIEF DESCRIPTION OF THE DRAWINGS

The drawings illustrate embodiments of the technology and are not limiting. It should be noted that for clarity and ease of illustration, these drawings are not made to scale and that in some instances various embodiments of the technology may be shown exaggerated or enlarged to facilitate an understanding of particular embodiments.

FIGS. 3A and 3D are partial cutaway views of the pouch outer layer or skin, showing the internal pillow or pad held within the pouch. FIG. 3A shows a perspective view of a pouch embodiment with a top discharge tab. FIG. 3B shows a side view of a pouch embodiment with a top discharge tab, and FIG. 3C shows an enlarged view of detail area A, illustrated in FIG. 3B. FIG. 3D shows a perspective view of a pouch embodiment with a side discharge tab. FIG. 3E shows a side view of a pouch embodiment with a side discharge tab, and FIG. 3F shows an enlarged view of detail area A, illustrated in FIG. 3E.

FIG. 4A shows results of a comparison performed where a subject is not wearing gloves. FIG. 4B shows results of a comparison performed where a subject is wearing latex gloves. FIG. 4C shows results of a comparison performed where a subject is wearing nitrile gloves. Experimental conditions are described in Example 2 herein.

DETAILED DESCRIPTION

Figure 1C:
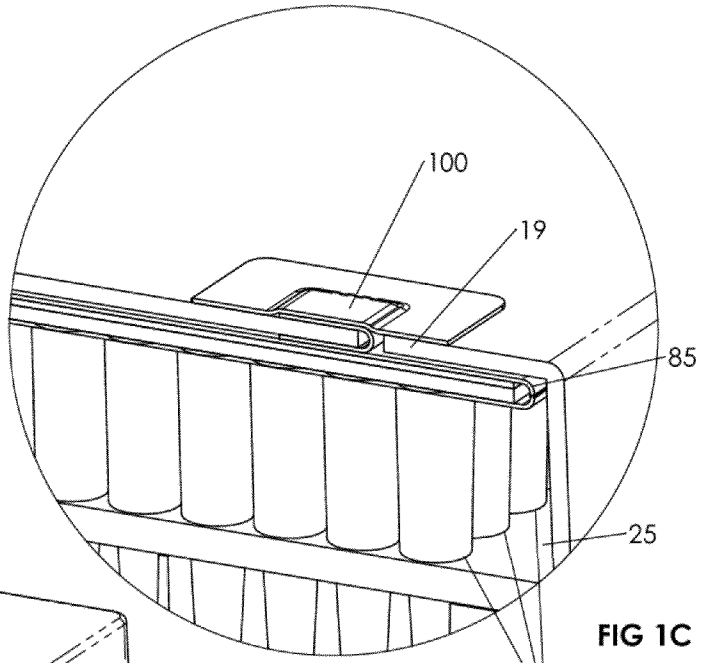
FIG. 1C is an enlarged view of the detail area highlighted in FIG. 1B.

Pipette tips often are jostled within their pipette tip trays during shipment. The rubbing of pipette tips within the apertures of the perforated card that contains them, or against other plastic surfaces, can generate an electrostatic charge on the exterior of the tips. This phenomenon often is applicable to tips of a smaller size (e.g., pipette tips that fit in 384 tip trays). The static charge can remain on the tips because there is no flow of the electric charge from the tips to the tip rack.

Static charge on the tips and other components of the tray may cause some of the tips to repel away from each other and other tray components. This repulsion can result in the tips arranged in a different orientation than intended, and can negatively impact interaction with pipette devices (e.g., automated dispensers). For example, static charge buildup can modify the positions of pipette tips in a tray, and nozzles of a robotic pipette dispenser cannot effectively engage one or more of the pipette tips, which can result in inaccurate liquid dispensing. Another result of electrostatic buildup is that pipette tips may dislodge from the card or be ejected out of the tray completely. These electrostatic forces also may be transferred from the pipette tips to a human user handling the tips themselves or with a liquid dispensing device. Static charge also may discharge a shock to samples or specimens with which the tips come into contact, which can distort the accuracy of assays being performed. Microscopic specimens, for example, bacteria or other organisms, may be affected by electrostatic force. Additionally, highly sensitive equipment (e.g., meters) may be effected by static charge and such delicate machinery is oftentimes found within laboratories or settings in which pipette tips are utilized. Static charge sometimes can also prevent proper pipette tip ejection from pipette devices.

Some pipette tip tray embodiments substantially immobilize pipette tips and thereby usefully minimize the amount of static charge generated on the pipette tips. Certain pipette tip tray embodiments are capable of usefully discharging electrostatic charge on pipette tips stored in the trays. Some pipette tray embodiments sometimes include a conductive tab in effective connection with one or more conductive members in the tray, which can be touched conveniently to a grounded object by a user for discharging electrostatic charge on the pipette tips in the tray. A tab sometimes is oriented at the top of a tray and/or the side of a tray for convenient access by the user, thereby allowing the user to pull the electrostatic charge up and out of the pipette tips in the tray. Pipette tip trays described herein are configured to discharge electrostatic charge by drawing the static electricity from the snap card up into the one or more electrically conductive members in the tray and out of the pipette tip tray by grounding to a user and/or object.

Pipette Tip Trays and Components

A pipette tip can be of any geometry useful for dispensing fluids in combination with a dispensing device. Pipette tips sometimes are available in sizes that hold from 0 to 10 microliters, 0 to 20 microliters, 1 to 100 microliters, 1 to 200 microliters and from 1 to 1000 microliters, for example. The external appearance of pipette tips may differ, and certain pipette tips can have a continuous tapered wall forming a central channel or tube that is roughly circular in horizontal cross section, in some embodiments. A pipette tip can have any cross-sectional geometry that results in a tip that (i) provides suitable liquid flow characteristics, and (ii) can be fitted to a dispenser (e.g., pipette), for example. Pipette tips sometimes taper from the widest point at the top-most portion of the pipette tip (pipette proximal end or end that engages a dispenser), to a narrow opening at the bottom most portion of the pipette tip (pipette distal end or end used to acquire or dispel fluid). In certain embodiments, a pipette tip wall includes two or more taper angles. The inner surface of the pipette tip sometimes forms a tapered continuous wall, in some embodiments, and in certain embodiments, the external wall may assume an appearance ranging from a continuous taper to a stepped taper or a combination of smooth taper with external protrusions. An advantage of an externally stepped taper is compatibility with pipette tip racks from different manufacturers. The bore of the top-most portion of the central channel or tube generally is wide enough to accept a particular dispenser apparatus (e.g., nozzle, barrel).

In some embodiments, a pipette tip has (i) an overall length of about 1.10 inches to about 3.50 inches (e.g., about 1.25, 1.50, 1.75, 2.00, 2.25, 2.50, 2.75, 3.00, 3.25 inches); (ii) a fluid-emitting distal section terminus having an inner diameter of about 0.01 inches to about 0.03 inches (e.g., about 0.015, 0.020, 0.025 inches) and an outer diameter of about 0.02 to about 0.07 inches (e.g., about 0.025, 0.03, 0.035, 0.04, 0.05, 0.06 inches); and (iii) a dispenser-engaging proximal section terminus having an inner diameter of about 0.10 inches to about 0.40 inches (e.g., about 0.15, 0.20, 0.25, 0.30, 0.35 inches) and an outer diameter of about 0.15 to about 0.45 inches (e.g., about 0.20, 0.25, 0.30, 0.35, 0.45 inches). In the latter embodiments, the inner diameter is less than the outer diameter.

The wall of the distal section of a pipette tip sometimes is continuously tapered from the wider portion, which is in effective connection with the proximal section, to a narrower terminus. The wall of the distal section, in some embodiments, forms a stepped tapered surface. The angle of each taper in a distal section is between about zero degrees to about thirty degrees from the central longitudinal vertical axis of the pipette tip (e.g., about 0, 1, 2, 3, 4, 5, 6, 7, 8, 9, 10, 11, 12, 13, 14, 15, 16, 17, 18, 19, 20, 21, 22, 23, 24, 25, 26, 27, 28, 29 or 30 degrees), in certain embodiments. In some embodiments, the wall of the distal section forms stepped vertical sections. The wall thickness of a distal section may be constant along the length of the section, or may vary with the length of the section (e.g., the wall of the distal section closer to the proximal section of the pipette tip may be thicker or thinner than the wall closer to the distal section terminus; the thickness may continuously thicken or thin over the length of the wall). The distal section of a pipette tip generally terminates in an aperture through which fluid passes into or out of the distal portion of the pipette tip. A distal section of a pipette tip may contain a filter, insert or other material, as addressed herein.

The wall of the proximal section of a pipette tip sometimes is continuously tapered from the top portion, to a narrower terminus towards the distal end. The top portion generally is open and often is shaped to receive a pipette tip engagement portion of a dispensing device. The wall of a proximal section, in some embodiments, forms a stepped tapered surface. The angle of each taper in the proximal section is between about zero degrees to about thirty degrees from the central longitudinal vertical axis of the pipette tip (e.g., about 0, 1, 2, 3, 4, 5, 6, 7, 8, 9, 10, 11, 12, 13, 14, 15, 16, 17, 18, 19, 20, 21, 22, 23, 24, 25, 26, 27, 28, 29 or 30 degrees), in certain embodiments. The wall thickness of a proximal section may be constant over the length of the section, or may vary with the length of the proximal section (e.g., the wall of the proximal section closer to the distal section of the pipette tip may be thicker or thinner than the wall closer to the top of the proximal section; the thickness may continuously thicken or thin over the length of the wall). A proximal section of a pipette tip may contain a filter, insert or other material, as addressed herein.

In certain embodiments, pipette tips in a pipette tray comprise one or more of a filter component and/or an insert component. A filter may be located in any suitable portion of a pipette tip, and sometimes is located in a proximal portion of a pipette tip near a pipette tip aperture that can engage a dispensing device. A filter can be of any shape (e.g., plug, disk; U.S. Pat. Nos. 5,156,811 and 7,335,337) and can be manufactured from any material that impedes or blocks migration of aerosols through the pipette tip to the proximal section terminus or visa versa, including without limitation, polyester, cork, plastic, silica, gels, and the like, and combinations thereof. In some embodiments a filter may be porous, non-porous, hydrophobic, hydrophilic or a combination thereof. A filter in some embodiments may include vertically oriented pores, and the pore size may be regular or irregular. Pores of a filter may include a material (e.g., granular material) that can expand and plug pores when contacted with aerosol (e.g., U.S. Pat. No. 5,156,811). In certain embodiments, a filter may include nominal, average or mean pore sizes of about 30, 25, 20, 15, 10, 9, 8, 7, 6, 5, 4, 3, 2, 1, 0.5, or 0.05 micrometers, for example. A section of a pipette tip also may include an insert or material that can interact with a molecule of interest, such as a biomolecule. The insert or material may be located in any suitable location for interaction with a molecule of interest, and sometimes is located in the distal section of a pipette tip (e.g., a material or a terminus of an insert may be located at or near the terminal aperture of the distal section). An insert may comprise one or more components that include, without limitation, multicapillaries (e.g., US 2007/0017870), fibers (e.g., randomly oriented or stacked, parallel orientation), and beads (e.g., silica gel, glass (e.g. controlled-pore glass (CPG)), nylon, Sephadex®, Sepharose®, cellulose, a metal surface (e.g. steel, gold, silver, aluminum, silicon and copper), a magnetic material, a plastic material (e.g., polyethylene, polypropylene, polyamide, polyester, polyvinylidenedifluoride (PVDF)), Wang resin, Merrifield resin or Dynabeads®). Beads may be sintered (e.g., sintered glass beads) or may be free (e.g., between one or two barriers (e.g., filter, frit)). Each insert may be coated or derivatized (e.g., covalently or non-covalently modified) with a molecule that can interact with (e.g., bind to) a molecule of interest (e.g., C18, nickel, affinity substrate).

A pipette tip tray generally is an assembly of components that present pipette tips for use by a user. A pipette tip tray can contain any suitable combination of components that facilitate presentation of pipette tips, including, but not limited to, a rack component, a card component, a bottom and a lid component. A rack component often comprises four sides, and optionally contains a grid structure within the body that confers rigidity to the rack component. In some embodiments, a rack component may comprise four sides, a bottom, and optionally contains a grid structure within the body. A card component includes, in certain embodiments, multiple apertures through which pipette tips are inserted in a process of assembling the pipette tip tray. A card component sometimes is affixed to a rack component via a snap fit. A card component sometimes is referred to as a "plate" and is referred to herein as the "top" of a rack. Thus, a top may be directly integrated with sides of the rack (e.g., four sides of the rack) in some embodiments, or may be an entity separate from the rack (e.g., snap fitted to the sides of the rack). Pipette tips often are inserted partially in the card, in certain embodiments, such that a portion of each pipette tip resides below the lower card surface within the rack body. A card component or top of a rack can contain any suitable number of apertures, including, without limitation, 8, 16, 24, 32, 40, 48, 56, 64, 72, 80, 88, 96, 384 or 1536 apertures, and pipette tips may be inserted in all, or a subset, or none of the apertures in a card component or rack top of a pipette tip tray.

In some embodiments, a pipette tip tray includes only one layer of pipette tips, where tips are arranged in a two-dimensional array. Such trays often include only one plate with apertures that receive pipette tips. In such embodiments, the proximal end of each pipette tip in the array is not in contact with a distal section of another pipette tip. Each pipette tip in a two-dimensional array of pipette tips (i.e., single layer of pipette tips) does not contact another pipette tip in the array, in certain embodiments where the pipette tips are substantially immobilized.

In some embodiments, a pipette tip tray includes more than one layer of pipette tips, where tips are arranged in a two-dimensional array and in a column of stacked tips arising at each array position in a third dimension, for example. Such trays can include more than one plate with apertures that receive pipette tips, oriented between each layer of tips in certain embodiments. In such embodiments, the proximal end of a pipette tip in the array sometimes is in contact with a distal section of another pipette tip. Any convenient number of layers of tips may be employed (e.g., 2, 3, 4, 5, 6, 7, 8, 9, 10 or more layers).

Each pipette tip tray component can be manufactured from a commercially suitable material. Pipette tip tray components often are manufactured from one or more moldable materials, independently selected from those that include, without limitation, polypropylene (PP), polyethylene (PE), high-density polyethylene, low-density polyethylene, polyethylene teraphthalate (PET), polyvinyl chloride (PVC), polyethylene-fluoroethylene (PEFE), polystyrene (PS), high-density polystryrene, acrylnitrile butadiene styrene copolymers, crosslinked polysiloxanes, polyurethanes, (meth)acrylate-based polymers, cellulose and cellulose derivatives, polycarbonates, ABS, tetrafluoroethylene polymers, corresponding copolymers and the like. A pipette tip tray component also may include one or more antimicrobial materials. An antimicrobial material may be coated on a surface (e.g., inner and/or outer surface) or impregnated in a moldable material, in some embodiments. One or more portions or sections, or all portions and sections, of a pipette tip or other pipette tip tray component may include one or more antimicrobial materials. In some embodiments, one or more pipette tip tray components are manufactured from an electrically conductive material (described hereafter), and in some embodiments, a lid, a rack and/or a card (and not the remaining portion of the rack) are manufactured from an electrically conductive material.

As shown in the figures, the lid can be seated on the rack where the rack body has an indentation for the lid to rest. In certain embodiments, the lid may also fit into a groove, shelf or depression on the rack (not shown). In some embodiments, a lid may connect to the rack by one or more connectors. In some embodiments, connectors include (i) hinges on one side of the tray, and/or (ii) male/female interlocking members (e.g., the male protruding member is located at various positions on the lid and the female concave member is located at similar positions on the rack body (or vice versa)).

Electrically Conductive Member or Members

An electrically conductive member may comprise any type of electrically conductive material known, such as conductive metal, for example. Examples of conductive metals include, without limitation, platinum (Pt), palladium (Pd), copper (Cu), nickel (Ni), silver (Ag) and gold (Au). The metals may be in any form in or on the conductive member, for example, such as metal flakes, metal powder, metal strands or coating of metal. An electrically conductive member, or portions thereof, may comprise a metal, polymeric material, foam, film, sheet, foil, salt or combinations thereof. In some embodiments, a conductive metal foil may be utilized for one or more components of a pipette tip tray (e.g., copper-aluminum foil; label adhered to an electrically conductive tab on exterior of a pipette tip tray component). The electrically conductive materials, or portions thereof, may be any material that can contain movable electric charges. In some embodiments, an electrically conductive material comprises carbon, for example. Non-limiting examples of types of carbon that can be utilized include carbon powder, carbon black, carbon particles and carbon fiber. In some embodiments, an electrically conductive member comprises about 5% to about 40% or more carbon by weight (e.g., 7-10%, 9-12%, 11-14%, 13-16%, 15-18%, 17-20%, 19-22%, 21-24%, 23-26%, 25-28%, 27-30%, 29-32%, 32-34%, 33-36%, or 35-38% carbon by weight). In certain embodiments, an electrically conductive film is utilized that includes carbon (e.g., commercially available from Gemini Plastic Enterprises, Inc., California). An electrically conductive film in some embodiments contains ethylene vinyl acetate (EVA), which can impart a supple quality to the film (e.g., about 5% to about 25% EVA by weight; about 6, 7, 8, 9, 10, 11, 12, 13, 14, 15, 16, 17, 18, 19, 20, 21, 22, 23, 24% EVA).

In certain embodiments, the pipette tips or portions thereof, are in contact with an electrically conductive member, which is in communication with the exterior of the tray. This contact may allow the static charge from the pipette tips to be discharged. An electrically conductive member, or portion thereof, can be in contact with the top proximal edges of pipette tips, which may involve direct, indirect, and/or effective communication with the inner portion of the lid, in some embodiments. The contact also sometimes involves contact of the sides of the tips which may be in direct, indirect, and/or effective communication with the card or top of the rack. In some embodiments, an electrically conductive member, or portion thereof, is in direct, indirect, and/or in effective communication with the pipette tips, which can ultimately aid in discharging the static charge from pipette tips. An electrically conductive member, or portions thereof, may be in effective communication with the lid, rack, or lid and rack and be in effective communication with the exterior tray. In certain embodiments, an electrically conductive member, or portion thereof, is located in the lid, and is in effective communication with the rack top or plate, side or bottom. In some embodiments, an electrically conductive member, or portion thereof, is located in the pipette tip rack plate or top, and is in effective communication with the rack lid, side or bottom. In certain embodiments, an electrically conductive member, or portion thereof, is located in part in the lid and in part in the top or plate, and is in effective communication with a rack side or bottom.

The term "effective communication" as used herein refers to direct (e.g., part of the conductive member) or indirect (e.g., via component not part of the conductive member) in communication with exterior of the tray. The term "exposure of conductive member" as used herein may refer to exposure by a reveal in lid or rack which may extend to the cage exterior or can be free hanging or may be affixed to an external surface of a tray, rack and/or lid. The external surfaces of the tray are, for example, the sides or bottom of the rack. The external surfaces of the lid are, for example, the top or sides of the lid. The term "affixed" as used herein refers to attachment, for example, such as embossed or adhesive.

An electrically conductive member may be in effective communication with any suitable portion or portions of a tray exterior. An electrically conductive member may be in direct contact or other contact (e.g., via a tab) with an exterior portion of a lid, rack, or lid and rack, in some embodiments. An exterior portion of a lid sometimes is a top of a lid, and at times is a side of lid, and sometimes a side of a lid and the top of a lid. In some embodiments, an exterior portion of a rack is a top (e.g., snap plate, card, integrated top), side, bottom, or combination thereof. Thus, a conductive element (e.g., tab) in effective contact with a conductive member (e.g., the conductive member is in contact with pipette tips) may be in contact with one or more exterior surfaces of the tray in some embodiments, and in certain embodiments, a conductive member (e.g., the conductive member is in contact with pipette tips) may be in direct contact with one or more exterior surfaces of the tray. In some embodiments, the rack or portion thereof (e.g., top (e.g., snap plate, card, integrated top), side, bottom), the lid or portion thereof (e.g., top of lid, side of lid), or combination thereof, comprises a conductive material and has conductive properties.

Pipette Tip Immobilization

Pipette tips may be substantially immobilized in their apertures in some embodiments. For example, movement of the pipette tips may be restrained within about 1.0 to about 0.0 millimeters (e.g., 1.0-0.5, 0.75-0.25, 0.5-0.0 and 0.75-0.0 mm) vertically (e.g., along the vertical axis of a pipette tip). Pipette tips can be restrained horizontally within the apertures in which they reside, in certain embodiments. Substantially immobilized pipette tips can move about 0 to about 0.005 inches side-to-side (horizontal direction) and up-and-down (vertical direction) in some embodiments. Vertical movement is in reference to the longitudinal axis of the tips, or top to bottom, or movement in the vertical plane. Horizontal movement is in reference to the lateral axis of the tips, or side to side, or right to left (or vice versa), or movement in the horizontal plane. A pipette tip can be substantially immobilized at any location along the vertical axis of the tip (e.g., a fixed element can contact a pipette tip at any point along the length of the pipette tip (e.g., at the proximal end, middle and/or distal end of a pipette tip, or any intermediate point there between)). When substantially immobilized, each pipette tip in a two-dimensional array of pipette tips (i.e., single layer of pipette tips) often does not contact another pipette tip in the array.

Pipette tip immobilization can be accomplished in a number of manners. In certain embodiments, the shape of apertures in a rack plate substantially immobilizes pipette tips. The walls of plate apertures can be tapered to substantially conform to the tapered walls of pipette tips, in some embodiments.

In certain embodiments, a plate can include one or more retainers located on the top surface, bottom surface and/or aperture wall of a rack plate that interact with a pipette tip inserted into an aperture and substantially immobilize the pipette tips in the plate. The retainers sometimes are projections extending from the top surface or bottom surface of the rack plate around each aperture, and/or extending from an aperture wall (e.g., 1, 2, 3, 4, 5, 6, 7, 8, 9, 10 or more projections around or in each aperture) that frictionally contact a pipette tip. Where a retainer frictionally engages a pipette tip, the retention force between a pipette tip and the retainer or retainers it contacts is less than the retention force between the pipette tip and a dispensing device with which it can engage, in some embodiments. In certain embodiments, the thickness of the rack plate is relatively increased resulting in each aperture having an increased contact surface area with each pipette tip (described in greater detail hereafter).

In some embodiments, the inner surface of the top of a pipette tip tray lid (e.g., inner surface of lid top 17, 17' in FIG. 2A and FIG. 2C) can directly or effectively contact top surfaces of pipette tips in a tray, thereby exerting a downward pressure onto the pipette tips and substantially immobilize them. In such embodiments, the lid can comprise an electrically conductive material (e.g., contain a certain percentage of a conductive material (e.g., carbon)), and/or an electrically conductive material (e.g., a metal foil) can be adhered to an inner surface of the lid top such that the conductive material is in contact with the top surface of pipette tips.

In certain embodiments, the top of a lid is not perfectly flat and can have curvature. Hence including a pliant material in effective contact with an interior surface of the lid can ensure the conductive member is in contact with all, or substantially all, pipette tips in the tray. Such a pliant material can apply pressure to top of pipette tips (when inside the lid) and sides of pipette tips (when inside the rack), thereby immobilizing tips. For example, about 2 to about 0.0001 Pa of pressure can be applied to pipette tips by a pliant member (e.g., 2-1.5 Pa, 1.75-1.25 Pa, 1.5-1.0 Pa, 1.25-0.75 Pa, 1.0-0.5 Pa, 0.75-0.25 Pa, 0.5-0.01 Pa, 0.25-0.005 Pa or 0.01-0.0001 Pa of pressure may be applied to the pipette tips by a pliant member). The term "pliant material" and "pliant member" as used herein refers to an article that can deform, be molded, change shape, be influenced by or modified by another material, and the like. In certain embodiments, pliant or moldable materials may have anti-static properties or may contain anti-static additives. Non-limiting examples of materials that have anti static properties (e.g., anti static resins or polymers) or additives that may be added to pliant or moldable materials during the pipette tip tray manufacture process to confer anti static properties are described herein.

An electrically conductive member can comprise pliant material in some embodiments. An electrically conductive member may be an elastomeric material in certain embodiments. Non-limiting examples of electrically conductive elastomers are described, for example, in International Patent Application Publication No. WO 2006/133440, entitled "Entitled Electrically Conductive Metal Impregnated Elastomer Materials And Methods Of Forming Electrically Conductive Metal Impregnated Elastomer Materials." Electrically conductive elastomers can be fabricated with a wide variety of polymers, including polymers that are compatible with microfabrication techniques. Electrically conductive elastomeric materials can be patterned using ultraviolet (UV) light shone through a mask in some embodiments, and can be patterned using other microfabrication techniques including, without limitation, photolithography, wet chemical etching, and dry etching and the like, in certain embodiments.

Electrically conductive elastomers can be formed and shaped into a variety of different geometries using methods such as casting, molding, and printing. Elastomers having sufficient elasticity can be natural or synthetic rubber materials including, without limitation, any one or combination of linear polymers, branched polymers, star polymers, comb polymers, linear copolymers, block copolymers, grafted polymers, random copolymers, alternating copolymers, and crosslinkers. Examples of elastomers include, without limitation, natural rubbers, polyisoprenes (e.g., copolymers of isobutylene and isoprene), polybutadienes (e.g., styrene butadiene copolymers), copolymers of polyethylene and polypropylene (e.g., ethylene propylene diene rubber or EPDM), polyacrylates (e.g., acrylate butadiene rubber or ABR), polyurethanes, polysulfides and silicon based materials such as silicones (e.g., polydimethylsiloxane or PDMS).

Electrically conductive elastomeric materials can be formed with suitable elastomer precursors that can be crosslinked or cured via a suitable process or technique. Examples of crosslinking techniques include, without limitation, exposure of the elastomer precursor to a source of energy such as heat or electromagnetic radiation such as ultraviolet (UV) light, or any suitable polymerization technique (e.g., step, chain or condensation polymerization) and/or the addition of a suitable chemical crosslinking agent to the precursor. An elastomer precursor has a suitable viscosity, or can be dissolved in a suitable solvent to obtain a suitable viscosity, that is sufficiently low (e.g., no greater than about 70,000 centipoise) to facilitate adequate mixing of the metal salt with the precursor during formation of the electrically conductive elastomer. An elastomer precursor can include any one or combination of suitable monomers, dimers, trimers, oligomers, polymers, sulfur groups, and crosslinking moieties that can be crosslinked to form any of the elastomers noted above. Examples of elastomer precursors include, without limitation, ethylene propylene materials, polybutadiene materials, latex materials such as isoprene, UV-curing and/or acrylic elastomers such as the type commercially available under the trade-names LOCTITE 3108 (Henkel Corporation, Connecticut), silicone materials such as the types commercially available under the trade name SYLGARD 184 and SYLGARD 186 (Dow Corning Corporation, Michigan), polyurethanes and fluoroelastomers.

Suitable metal salts for impregnating elastomeric materials often are soluble in the elastomeric precursor during formation of the elastomer and are reducible to metals when exposed to one or more suitable chemical reducing agents. The metal salts can include any metals that are suitably conductive and/or have suitable magnetic properties including, without limitation, salts of platinum, silver, palladium, gold, copper and iron. Examples of metal salts that can be used in forming the conductive metal impregnated elastomers of the technology include, without limitation, tetraammineplatinum (II) chloride ($Pt(NH_3)_4Cla$), tetraammineplatinum(II) nitrate ($Pt(NH_3)_4(NO_3)_2$), tetraammineplatinum(II) hydroxide ($Pt(NH_3)_4(OH)_2)_5$ dichlorophenanthrolinegold(III) chloride $[Au(phen)Cl_2]Cl)_5$ bis(ethylenediamine)gold(III) chloride ($[Au(en)_2]Cl_3$), tetraamminepalladium(II) chloride ($Pd(NH_3)_4Cl_2$), tetraamminepalladium(II) nitrate ($Pd(NH_3)_4(NO_3)_2$), silver nitrate and copper sulfate. An elastomer precursor often is mixed with a metal salt so as to sufficiently disperse the salt in the precursor material. Any suitable mixing techniques can be implemented to mix the metal salt with an elastomer precursor including, without limitation, mixing by hand, using a homogenizer, and using a mechanical stirrer. In certain embodiments, a metal salt can be mixed directly into an elastomer precursor. In some embodiments, a salt is mixed in a suitable solvent (e.g., water or organic solvents) and then a metal salt solution is mixed with an elastomer precursor. The latter procedure can be useful when the solvent has only a small miscibility with the precursor. In mixing techniques using a solvent, any excess solvent that separates from the polymer mixture can be subsequently removed from the mixture. Any suitable dispersal agent or compound that facilitates or enhances mixing of a metal salt with a precursor may also be used in the mixing process.

In certain embodiments, a pliant member may be separately manufactured and placed in effective communication with an electrically conductive member, for example. A pliant member may be affixed directly or via adhesive, or have another component between (e.g., insulation layer), in some embodiments. Examples of pliant materials and members include but are not limited to polymers and foams. Any suitable material can be used to construct the pliant member, including, without limitation, materials having a hardness grade from 35 Shore A to 50 Shore D. In certain embodiments, the pliant member is constructed using a thermoplastic elastomer (TPE), including without limitation, styrenic block copolymers, polyolefin blends, elastomeric alloys, thermoplastic polyurethanes, thermoplastic copolyester and thermoplastic polyamides. Examples of TPE products from the block copolymers group are STYROFLEX (BASF), KRATON (Shell Chemicals), PELLETHANE (Dow chemical), PEBAX, ARNITEL (DSM), HYTREL (Du Pont) and more. Examples of commercially available elastomeric alloys include SANTOPRENE (in-situ cross linked polypropylene and EPDM rubber; Monsanto), GEOLAST (Monsanto) and ALCRYN (Du Pont). Further examples of the materials that can be used to construct the annular member include, without limitation, thermoplastic vulcanizates (TPV; SANTOPRENE TPV), thermoplastic polyurethane (TPU), thermoplastic olefins (TPO), polysulfide rubber, ethylene propylene rubber (e.g., EPM, a copolymer of ethylene and propylene), ethylene propylene diene rubber (e.g., EPDM, a terpolymer of ethylene, propylene and a diene-component), epichlorohydrin rubber (ECO), polyacrylic rubber (ACM, ABR), silicone rubber (SI, Q, VMQ), fluorosilicone Rubber (FVMQ), fluoroelastomers (e.g., FKM, and FEPM, VITON, TECNOFLON, FLUOREL, AFLAS and DAI-EL), perfluoroelastomers (e.g., FFKM, TECNOFLON PFR, KALREZ, CHEMRAZ, PERLAST), polyether block amides (PEBA), chlorosulfonated polyethylene (CSM, e.g., HYPALON), ethylene-vinyl acetate (EVA), synthetic polyisoprene (IR), butyl rubber (copolymer of isobutylene and isoprene, IIR), halogenated butyl rubbers (chloro butyl rubber: CIIR; bromo butyl rubber: BIIR), polybutadiene (BR), styrene-butadiene rubber (copolymer of polystyrene and polybutadiene, SBR), nitrile rubber (copolymer of polybutadiene and acrylonitrile, NBR; Buna N rubbers), hydrogenated nitrile rubbers (HNBR, THERBAN and ZETPOL), chloroprene rubber (CR, polychloroprene, NEOPRENE, BAYPREN) and the like. In certain embodiments, the pliant member is constructed using polyurethane foam, XPS foam, Styrofoam, syntactic foam, nanofoam, metal foam, and the like.

In certain embodiments, the rack comprises an electrically conductive member and/or a pliant material in effective connection with the pipette tips. In some embodiments, the rack or a component of the rack (e.g., snap plate), comprises an electrically conductive material (e.g., is manufactured from an electrically conductive material). A pliant material may be in effective contact with an electrically conductive member. The electrically conductive member may comprise the pliant material. The rack and the lid may comprise an electrically conductive member, and in some embodiments, the rack and lid comprise an electrically conductive material such that the rack and lid are electrically conductive. The rack and the lid may comprise a pliant material in effective connection with the pipette tips. The pliant material may be in effective contact with the electrically conductive member. The electrically conductive member may comprise the pliant material or combinations thereof.

In some embodiments, the lid comprises an aperture that exposes a portion of an electrically conductive member. The rack may also comprise an aperture that exposes a portion of an electrically conductive member. The rack and the lid also may comprise an aperture that exposes a portion of an electrically conductive member. A portion of an electrically conductive member may extend to the exterior of the pipette tip tray, extend through the lid, is in effective connection with an exterior surface of the lid, extend through the rack, and/or is in connection with an exterior surface of the rack, in some embodiments. In certain embodiments, the rack comprises a bottom, the pipette tips comprise polypropylene, the rack comprises polypropylene, and/or the lid comprises polypropylene or combinations thereof.

In certain embodiments, an electrically conductive material is in the form of a film which may form a pouch having an interior space (e.g., an air bladder, air pillow or air bag) and optionally may contain a pliant material within the interior space. A pliant material sometimes is a foam, such as a closed-cell polyurethane foam in certain embodiments. In certain embodiments a pliant material sometimes is an open-cell foam (e.g., polyurethane or other suitable open-cell foam). In some embodiments, the pouch comprises a support material within the interior space. The support material can function as shape stabilizer for the pliant material. In certain embodiments, a pliant material can deform extensively, and optional use of a shape stabilizer can retain the shape of the pliant material. A support material sometimes is formed from a rigid or semi-rigid material, such as a die-cut corrugated pad in certain embodiments. In certain embodiments, the pouch does not have openings. In some embodiments, the pouch is formed from a tube-shaped structure of the film having two openings that are optionally sealed. The openings may be sealed by any method known, for example, such as by an impulse heat sealer in some embodiments.

In some embodiments, an electrically conductive member of a rack is in effective connection with an electrically conductive tab. A user can contact the tab (e.g., contact the tab with a grounded object (e.g., a wire, finger of the user), and discharge static electricity from the rack and/or pipette tips stored therein via the tab. One or more tabs may be in contact with one or more electrically conductive rack component. For example, a tab may be in contact with one or more of a snap plate, a lid, a pouch and combinations of the foregoing (e.g., the lid and snap plate).

In certain embodiments, the pouch comprises a tab. The tab optionally may be formed from the same film as the pouch, and may be coextensive with the pouch in certain embodiments. A tab may be a separate member that is affixed to a pouch in some embodiments (e.g., constructed from the same or different material than the pouch). A tab also may be exposed to the tray exterior and exposure may be via protrusion through an aperture in the pipette trip tray (e.g., aperture in the lid and/or rack). In some embodiments, a tab is a member separate from the pouch, where a portion of the tab extends to the lid exterior and a portion of the tab extends in the lid interior through an aperture in the lid. In related embodiments, the portion of the tab located in the lid interior is between a pouch and an interior surface of the lid top, and in direct contact with the pouch and the lid interior surface.

In certain embodiments, a tab may be coextensive with a rack or portion thereof (e.g., snap plate), and sometimes a tab is a member separate from the rack or portion thereof. In some embodiments, a portion of a tab extends through an aperture in a surface of the rack (e.g., rack side, snap plate, rack bottom). In certain embodiments, a portion of a tab is in direct connection or effective connection with a conductive snap plate, and another portion of the tab is in effective contact with an exterior surface of the rack (e.g., side surface, bottom surface). In some embodiments, a pipette tray includes a tab in association with the lid and a separate tab in association with the rack and/or a component thereof (e.g., snap plate).

A tab may be in effective contact with an exterior surface of the pipette tip tray in some embodiments, and sometimes the tab is affixed to an exterior surface of the lid and/or rack. In certain embodiments, a tab is affixed to an exterior surface of a lid top. In some embodiments, a tab is affixed to an exterior surface of a lid side (e.g., the tab is affixed at the center point of the lid side along the vertical and horizontal axes). In related embodiments, for example, a member of an automated dispensing device that engages pipette tip tray lids can effectively contact the tab and discharge electrostatic charge on the pipette tips. In some embodiments, a portion of a tab is affixed to an exterior surface of a rack, such as a rack side, or bottom portion of the rack (e.g., the tab can be grounded when the rack is placed on a grounded surface), for example.

In some embodiments, a tab is in effective contact with an exterior surface of the pipette tip tray via an adhesive. The tab may be in effective contact with an electrically conductive support. In some embodiments, the support can comprise electrically conductive metal, such as copper, for example. In some embodiments, the electrically conductive support is a label. The adhesive placing the tab in effective contact with the exterior of the tray may be electrically conductive in some embodiments.

In some embodiments, a film (e.g. material from which a pouch sometimes is made) comprises about 7% to about 40% or more carbon by weight (e.g., about 7-10%, 9-12%, 11-14%, 13-16%, 15-18%, 17-20%, 19-22%, 21-24%, 23-26%, 25-28%, 27-30%, 29-32%, 32-34%, 33-36%, or 35-38% carbon by weight). In certain embodiments, the film may be extruded, blown and/or extruded and blown. The pouch may be in effective contact with an interior surface of the lid. The pouch may be affixed to an interior surface of the lid by an adhesive. In some embodiments the adhesive can be adhesive transfer tape, such as two-sided adhesive transfer tape (3M), for example. In certain embodiments, the pouch may be affixed to an interior surface of the lid by a pressure or friction fitment. In some embodiments the pouch may be affixed to an interior surface of the lid by a combination of adhesive and pressure or friction fitment.

Substantially immobilizing pipette tips in pipette tip trays can significantly reduce the amount of electrical charge (e.g., static charge) accumulated on or in pipette tips. Substantial immobilization may be accomplished in part or in full by directly contacting tops of pipette tips with the inner surface of a lid top, where the lid top applies downward pressure onto the proximal portion or top of the pipette tips (e.g., along the vertical axis of the tips). In the latter embodiments, the lid can be constructed from an electrically conductive material (e.g., there is no pliant material or separate electrically conductive material in association with the lid in certain embodiments), and in some embodiments, the lid is in effective contact with an electrically conductive member residing between the tops of the pipette tips and the inner surface of the lid (e.g., a foil, membrane or film adhered to the inner surface of the lid), and there is no pliant material in association with the lid in some embodiments. In the latter embodiments, a pipette tip tray may be provided with the lid affixed at one or more locations to one or more locations on the rack (e.g., by tape adhesive, label adhesive and/or pressure or friction fitment).

Substantial immobilization also may be accomplished in part by effectively contacting the pipette tips in a pipette tip tray with a pliant material that deforms against the tips, exerts pressure on the tips and reduces tip movement in the vertical direction, horizontal direction or horizontal and vertical directions. In certain embodiments, the pipette tips in a pipette tip tray may be in contact with a "pillow" affixed to the inner surface of the lid of a pipette tip box or rack that can aid in immobilizing the pipette tips when the lid is placed on the pipette tip/rack assembly. In some embodiments, the pillow can be made in part from a pliant material. In certain embodiments, the pillow can comprise a pliant material within a pouch formed from electrically conductive material. In some embodiments, the pliant material in the pillow top can be electrically conductive material. The terms "pillow", "pillow-top" or "pad" and grammatical variants thereof, as used herein refer to a pliant material (e.g., conductive or non-conductive) sometimes wrapped in, or encased in an electrically conductive material (see above for, example), and can be used interchangeably. A pillow can be affixed, by any suitable means, to the inner surface of top of the lid. The pliant material and/or the entire pillow-top is sufficiently thick that it makes contact with the top of pipette tips held in the rack, thereby further immobilizing the pipette tips in the rack.

Substantial immobilization also may be accomplished without a pliant member or material in some embodiments. Substantial immobilization may be accomplished in part or in full by providing a card (i.e., plate, rack top) having a thickness between about 0.05 inches to about 0.5 inches (e.g., about 0.06, 0.07, 0.08, 0.09, 0.1, 0.2, 0.3, 0.4 inches), where thicker cards can provide greater tip immobilization. Thicker cards can advantageously provide greater side-to-side tip immobilization in a pipette tip tray, which can be especially useful when a pipette tip tray is stored and transported on one of its sides (e.g., tip movement is reduced during transportation of the pipette tip tray, and static charge buildup is reduced). Substantial immobilization also may be accomplished in part or in full by incorporating one or more retainers at or near each card aperture that restricts tip movement in horizontal, vertical or horizontal and vertical directions. Any convenient and effective number of retainers can be utilized (e.g., about 8, 7, 5, 4, 3, 2 or 1 retainer), and the retainers can be of any suitable shape that restricts the movement of tips within the apertures in which they reside. For example, a retainer may be a tab or ridge that extends inwards at or near the edge of an aperture towards the interior of the aperture. The retainer may be coextensive with the card in some embodiments, and may be a separate member with respect to the card in certain embodiments.

In some embodiments, a "stack and rack" system may be used to substantially immobilize pipette tips. The term "stack and rack" as used herein, refers to two or more layers of pipette tips in a single rack, where the additional height of tips stack inside one another results in the top most level of tips making effective contact with the rack lid, and thereby immobilizing the pipette tips when the lid is placed on the pipette tip/rack assembly. In certain embodiments, substantial pipette tip immobilization also may be accomplished by the use of a thicker snap plate. The use of a thicker snap plate can allow additional surface area for contact between the outer surface of the pipette tips and the snap plate. The additional material (e.g., surface area) can further aid in pipette tip immobilization. Further non-limiting examples of methods for pipette tip immobilization include, protrusions from the inner top surface of the lid and columns protruding from the inner surface of the base.

Many commercially available pipette tip trays do not substantially immobilize pipette tips. For example, pipette tip trays that (i) do not include a lid that directly or indirectly applies pressure to the top surface of pipette tips in the rack, or (ii) do not include features in the rack (e.g., snap plate) that restrict side-to-side movement of the pipette tips, often do not substantially immobilize pipette tips.

Methods of Manufacture

A device of the present technology incorporating, carrying or coated with material which may contain movable electric charges in or on an electrically conductive member(s) may be produced by any application method or process known. For example, each component of the pipette tray may be molded individually then assembled together. In certain embodiments, application methods are utilized that direct vaporized metal at the device surface and deposit a thin metallic film. In some embodiments, processes are utilized in which a die, mold or cast is used to form the tray or parts thereof. In certain embodiments, materials that confer anti static properties (e.g., carbon powder, carbon particles, carbon fiber, halogenated compounds, other additives addressed herein, combinations thereof and the like) can be added to molten polymers or plastics prior to or during the forming or molding process. Below are non-limiting examples of different types of processes that can incorporate or apply a material which may contain movable electric charges in or on an electrically conductive member(s) of a pipette tray.

Extrusion is a process used to create objects of a fixed cross-sectional profile. A material often is pushed or drawn through a die of the desired cross-section. The two main advantages of an extrusion process over other manufacturing processes is the ability to create complex cross-sections and work materials that are brittle, because the material only encounters compressive and shear stresses. Such processes can be utilized to form finished parts with an excellent surface finish. Extrusion may be continuous (e.g., theoretically producing indefinitely long material) or semi-continuous (e.g., producing many pieces). The extrusion process can be performed with the material hot or cold.

Molding is a process of manufacture by shaping pliable raw material using a rigid frame or model called a mold. A mold often is a hollowed-out block filled with a liquid, including, without limitation, plastic, glass, metal, or ceramic raw materials. The liquid hardens or sets inside the mold, adopting its shape. A release agent sometimes is used to facilitate removal of the hardened or set substance from the mold.

Thermoforming is a manufacturing process for thermoplastic sheet or film. The sheet or film is heated between infrared, natural gas, or other heaters to its forming temperature. Then it is stretched over or into a temperature-controlled, single-surface mold. The sheet is held against the mold surface unit until cooled. The formed part is then trimmed from the sheet. The trimmed material is usually reground, mixed with virgin plastic, and reprocessed into usable sheet. There are several categories of thermoforming, including vacuum forming, pressure forming, twin-sheet forming, drape forming, free blowing, and simple sheet bending.

Injection molding is a manufacturing technique for making parts from both thermoplastic and thermosetting plastic materials in production. Molten plastic is injected at high pressure into a mold. Molds may be made from steel or aluminum, and precision-machined to form the features of the desired part.

Casting is a manufacturing process by which a liquid material generally is flowed into a mold, which contains a hollow cavity of the desired shape, and then the liquid material is allowed to solidify. The solid casting is then ejected or broken out to complete the process. Casting may be used to form hot liquid metals or various materials that cold set after mixing of components (such as epoxies, concrete, plaster and clay). Casting is most often used for making complex shapes that would be otherwise difficult or uneconomical to make by other methods. The casting process is subdivided into two distinct subgroups: expendable and non-expendable mold casting.

Expendable mold casting is a generic classification that includes sand, plastic, shell, plaster, and investment (lost-wax technique) moldings. This method of mold casting involves the use of temporary, non-reusable molds. Non-expendable mold casting differs from expendable processes in that the mold need not be reformed after each production cycle. This technique includes at least four different methods: permanent, die, centrifugal, and continuous casting.

Using any of the techniques disclosed herein or those known to one of skill in the art, a pipette tray may be manufactured, for example, by constructing or mixing material which may contain movable electric charges into a precursor of the molded or formed material or directly into the material itself before formed and added to the electrically conductive member(s). In some embodiments, a tray as provided herein may have the material which may contain movable electric charges manually mixed into a precursor mixture or the substance of the body itself as it is being manufactured. In certain embodiments, a tray as provided herein may have the material which may contain movable electric charges diffused into the body of the tray as it is being manufactured. Alternatively, a tray may be sprayed or coated with material which may contain movable electric charges after formed or a combination of diffusion into the body of the device and coating after formation thereof.

Affixing components that adhere or attach parts onto the pipette tray may include any adhesive known to those of skill in the art, for example such as glue, gum, anaerobics, cyanoacrylates, toughened acrylics, epoxies, polyurethanes, silicones, phenolics, polyimides, hot melts, pastisols, polyvinyl acetate and pressure-sensitive adhesives and the like. Methods that affix components together may include any methods known to those of skill in the art, for example such as embossing, fastening, stitching, laminating, welding, solder, melting, sealing, bonding and the like.

In certain embodiments a pipette tip tray may be provided with the lid affixed to the rack at one or more points. For example, one or more lid sides may be affixed to one or more sides of the rack via an intermediate. The intermediate in some embodiments is an adhesive tape and/or an adhesive label.

In certain embodiments, a pouch can be prepared by providing an electrically conductive film in the form of a polymeric tube, inserting a pliant member and optionally a support member in the tube, and sealing the tube at each of the open ends. The tube may be cut (e.g., die cut) and a tab can be included when the polymeric tube is cut (e.g., the tab can be coextensive with the pouch after assembly).

Methods of Use

The amount of charge created by triboelectric charging is affected by the area of contact, the speed of separation of the objects, relative humidity, and other factors. In certain embodiments, the electrically conductive material is in effective communication with a grounded object to discharge static electricity. The term "object" as used herein refers to an object that can absorb electric charge or act as an intermediary that can transmit electric charge to another body or acts as a conduit which controls the current flow of electric charge away and decreases the charge to 0 coulombs. An object often is a grounded object, and is a human body in certain embodiments (e.g., a person touches his or her finger to an electrically conductive tab on a pipette tip tray). An example of a grounded object is a human being. The terms "contact" and "effectively contact" as used herein refer to touching, immediate proximity or association, or a junction of electric conductors.

Contact or effective contact may be direct or indirect (e.g., static charge may be transmitted via one or more wires to a grounded body). In some embodiments, wires may contact pipette tips indirectly (e.g., wires may contact another pipette tip tray member that contacts the pipette tips), and/or may be in direct contact with the electrically conductive member which is in direct contact with the pipette tips. The term "discharged" as used herein refers to some or all of the static charge or current being transmitted from the pipette tips to a grounded object. The electrical charge or current that may be transmitted can be, for example, about 5000 to about 0.0001 volts (e.g., about 1,500-1,000, 1,250-750, 1,000-500, 750-250, 500-0, or 250-0 volts), which can be accomplished in a rapid period of time (e.g., about 5 seconds or less (e.g., about 4, 3, 2, 1, 0.5, 0.1, 0.01, 0.001 or 0.0001 seconds). For example, an electrically conductive film for use herein can transmit about 5000 volts in about 2 seconds or less. All or a portion of static charge on or in pipette tips may be discharged (e.g., 100% discharged, or about 99%, 95%, 90%, 85%, 80% or 75% of the charge is discharged from the tips). In some embodiments configured with an electrically conductive pouch (e.g., film surrounding a pillow or pad) affixed to the lid, the static charge on or in pipette tips is discharged in an area substantially equivalent to the size of the electrically conductive pouch affixed to the lid.

In some embodiments, a pipette tip tray described herein is provided, any electrical charge in the pipette tips is discharged, and the pipette tips are contacted with a dispenser. In some embodiments, the dispenser dispenses a fluid in the pipette tips from the pipette tip tray, and in certain embodiments, the pipette tips are returned to the pipette tip tray after fluid is dispensed. After the tips are returned to the pipette tip tray after fluid is dispensed, any electrical charge in the tips (e.g., resulting from the dispensing process) is discharged, in certain embodiments.

Example 1

Comparison of Static Electricity Generation

Figures 2A, 2B:
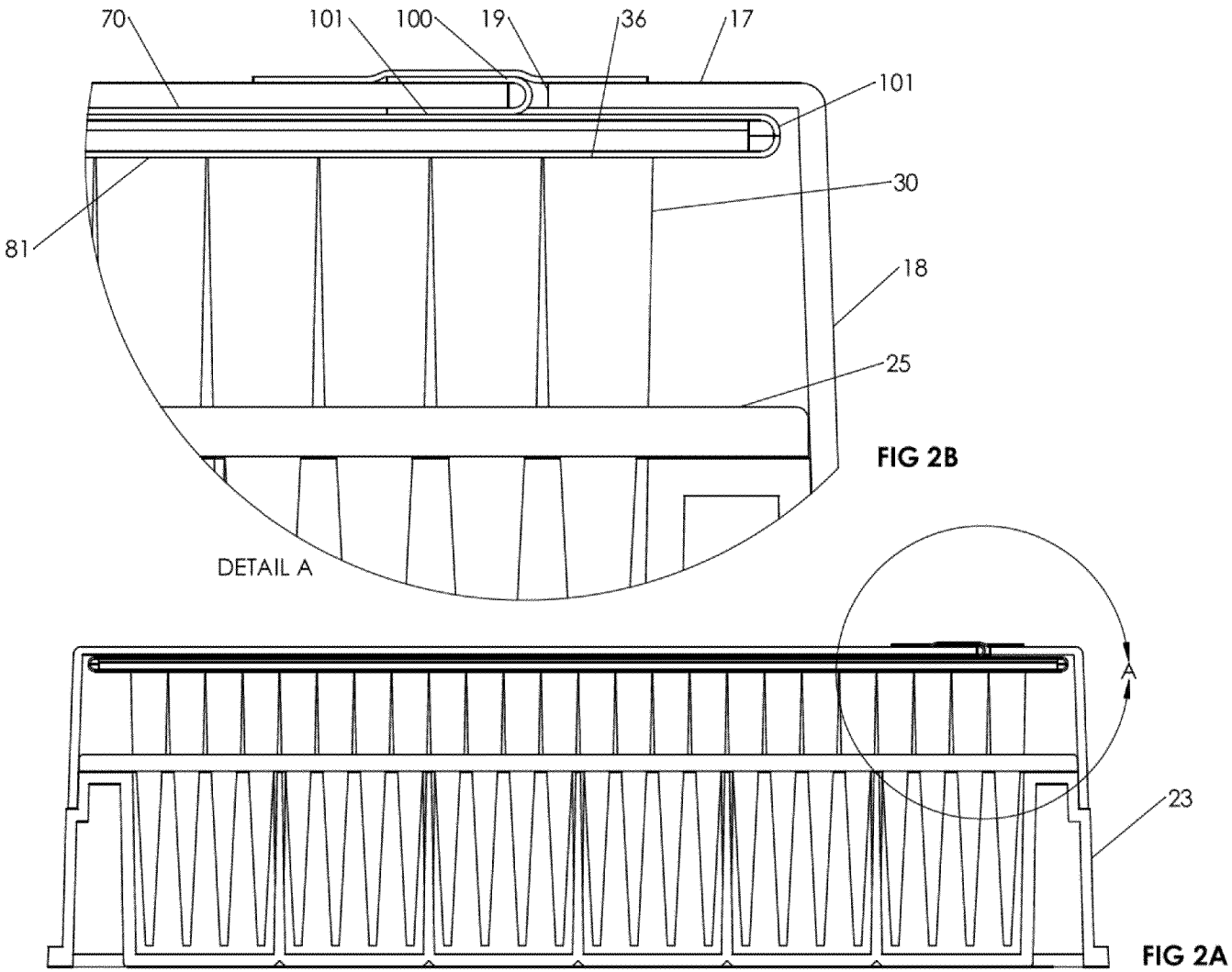
FIG. 2A is a side view in partial section of a pipette tip tray embodiment with a top discharge tab as described herein.
FIG. 2B is an enlarged view of detail area A in FIG. 2A.

Electrostatic charge was measured for pipette tips in test trays having a structure similar to that shown in FIGS. 2A and 2B, and compared to electrostatic charge measurements for pipette tips in other commercially available trays. Commercially available trays included tray A from Molecular Bio Products (MBP, catalog number BA-0030-35C), tray B from Axygen (catalog number 935-261-05) and tray C from Beckman (catalog number 719225). Tray A and Tray B each included a conductive snap plate in which the tips resided, as represented by the manufacturer.

Each tray was vigorously shaken for approximately two minutes, which generated static charge on pipette tips in the tray and simulated shipping and handling conditions experienced by the trays and tips in commercial use over time. The lid of each tray was removed, and the resulting electrostatic charge on the pipette tips was immediately measured at multiple points across the array of pipette tips in each tray using a Simco FMX Electrostatic Field Meter. For the test tray, an operator first touched conductive material located on the tray lid with the operator's finger before electrostatic charge on the pipette tips was measured. The maximum electrostatic charge observed was recorded for each tray, and is presented in the following table.

| Test tray | Tray A | Tray B | Tray C |
|---|---|---|---|
| −0.3 kV | −3.5 kV | −8.8 kV | −0.6 kV |

The relatively low electrostatic charge generated on the test tray pipette tips is evidence that the combination of (i) immobilizing pipette tips, and (ii) contacting the pipette tips with a conductive material, and grounding the conductive material, reduces electrostatic charge generated on pipette tips in trays during commercial use.

Example 2

Comparison of Static Electricity Generation and Dissipation

A competitor's 384-well pipette tip tray product (tray C from Example 1) was used to test for static generation and dissipation, against the anti-static pipette tip trays described herein. The anti-static pipette tip tray embodiment used in the test was configured with a conductive cushion fitted inside the lid, as illustrated in the figures. Considering manufacturing and shipping environments, all tips were exposed to de-ionized air to ensure similar initial static charge. The trays were agitated at 3600 vibrations per minute for 10 minutes simulating static generated by production, assembly, transport and storage. Static measurements were subsequently collected from the experimental trays (e.g., the tray described herein and the competitors tray) after engaging the conductive material for 15, 30, 45 and 60 seconds, while competitive samples were allowed to rest for 15, 30, 45 and 60 seconds. The static test was repeated wearing latex gloves and nitrile gloves in order to test several possible lab settings.

As noted above, the trays used for experimental testing were exposed to de-ionized air, so the initial static reading of each tray was determined to be between 0.03 kV and 0.00 kV. The static generated from agitation was recorded and compared with the static data taken at 15, 30, 45 and 60 seconds after agitation in order to track the rate of static dissipation in each tray.

As shown in the table, only the anti-static pipette tray described herein showed a considerable decrease in static charge.

| | % Dissipation | |
|---|---|---|
| | Test tray | Tray C |
| w/o Gloves | 98.15% | 13.33% |
| w/Latex Gloves | 72.41% | 4.25% |
| w/Nitrile Gloves | 44.87% | 10.00% |

The anti-static pipette tip trays described herein show an average of 71.81% dissipation in 60 seconds overall for all three conditions (no gloves, latex gloves and nitrile gloves). The overall percentage of dissipation with no gloves is 98.15%, wearing latex gloves is 72.41% and wearing nitrile gloves is 44.87%. The competitive product also showed little decrease of static present as the percentage of dissipation is 13.33% wearing no gloves, 4.25% wearing latex gloves and 10.00% wearing nitrile gloves.

Figure 4A:
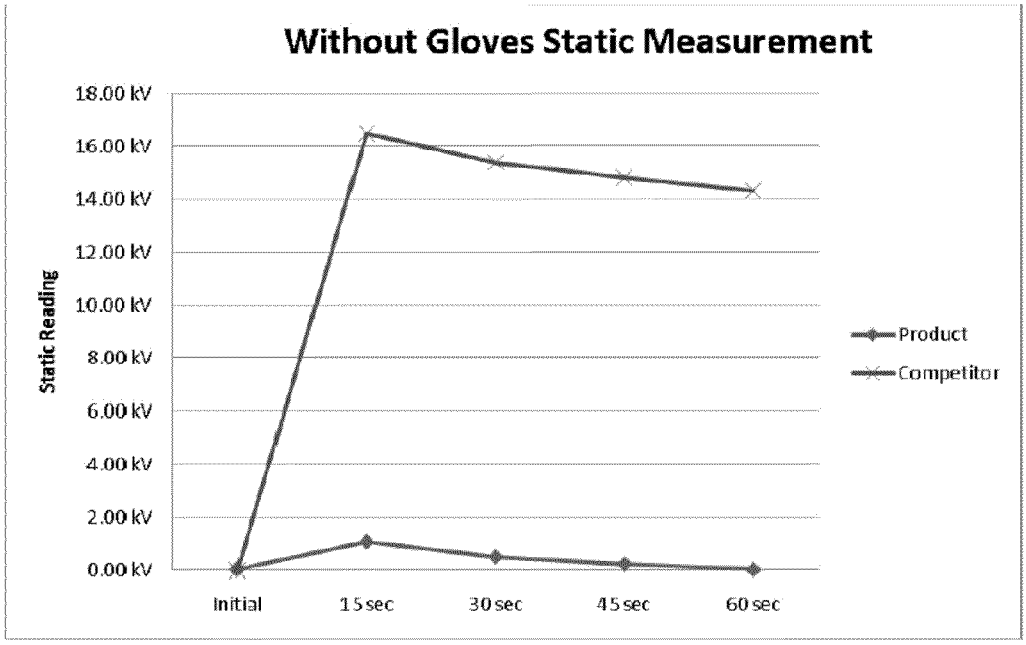
FIGS. 4A-4C graphically illustrate comparison results of static electricity generation and dissipation between pipette tips described herein and other pipette tips.
Figure 4B:
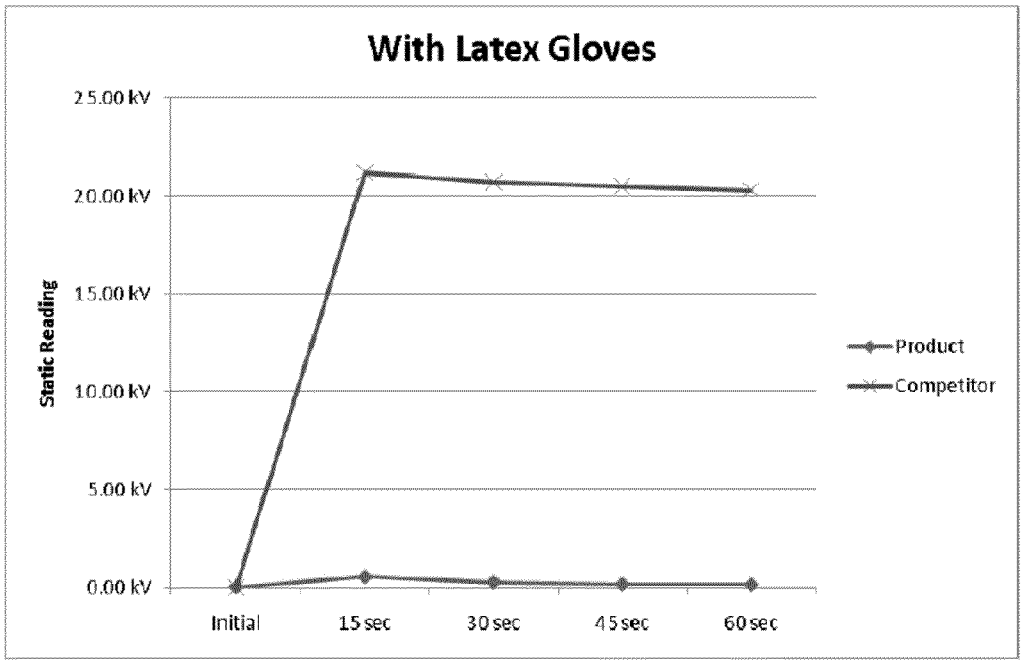
Figure 4C:
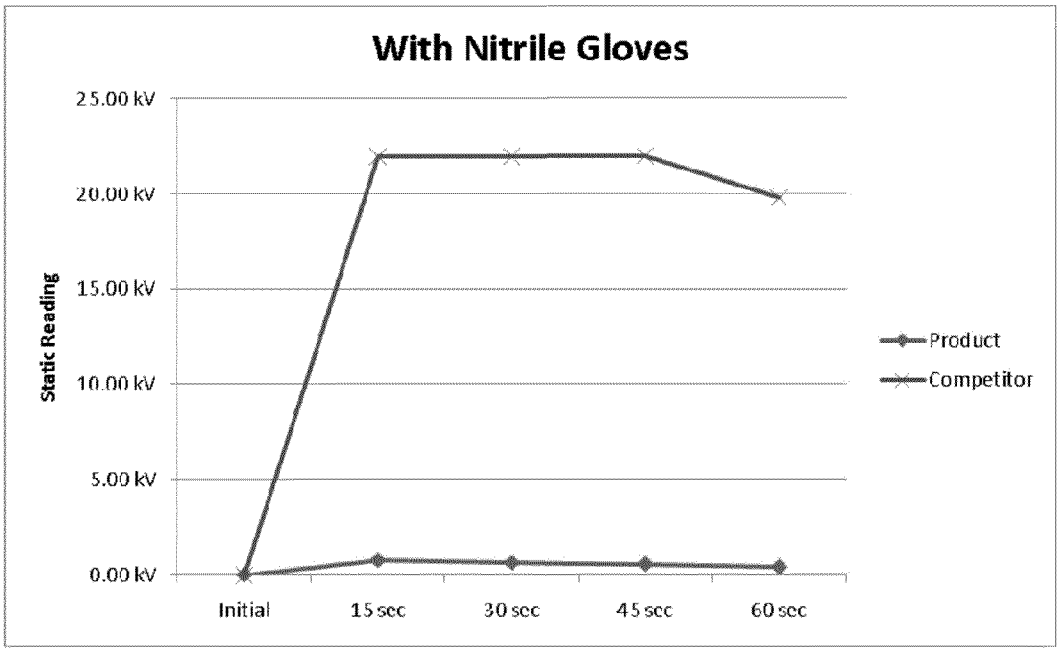

FIGS. 4A-4C, show the anti-static pipette tip trays described herein efficiently prevented the buildup of static and dissipated the small amount of static generated in all three lab conditions compared to the competitor's product. A considerable difference is seen when comparing the competitors product with the pipette tip trays described herein, with respect to static electricity generation and dissipation. The competitive product generated 27 times more static after the 10 minute agitation period and dissipated the static 296 times less efficiently.

Example 3

Examples of Embodiments

Shown in the FIGS. 1A-1C, 2A-2D and FIGS. 3A-3F are certain non-limiting embodiments of anti-static pipette tip trays and components.

Figure 1A:
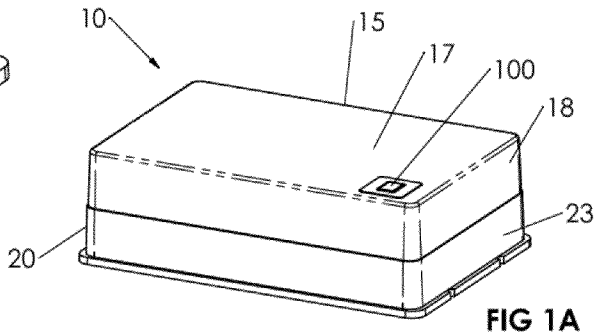
FIG. 1A is a perspective view of a pipette tip tray embodiment with a top mounted discharge tab.
Figure 1B:
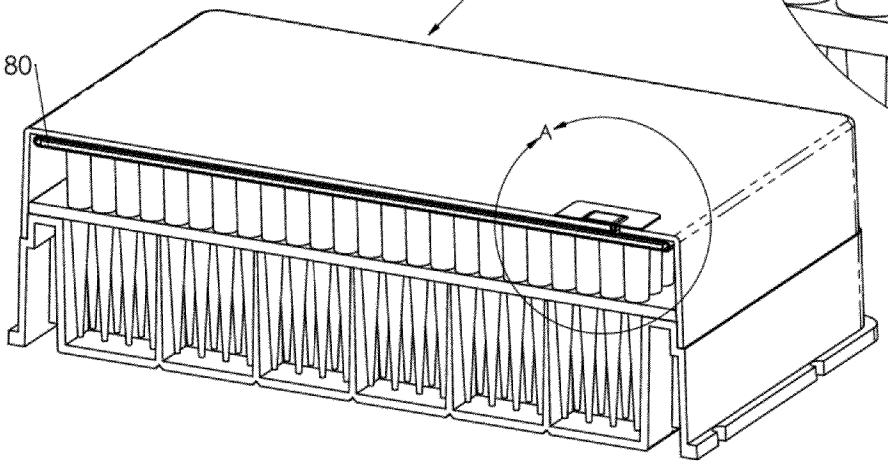
FIG. 1B is a perspective view in partial section of a pipette tip tray embodiment with a top mounted discharge tab.

FIG. 1A is a perspective view of a pipette tip tray embodiment as described herein with a top mounted discharge tab. FIG. 1B is a perspective view in partial section of a pipette tip tray embodiment as described herein. FIG. 1C is an enlarged view of detail area A in FIG. 1B. Shown in FIGS. 1A-1C are pipette tip tray embodiment 10, lid 15, having a top 17, sides 18 and aperture 19 in side 18; rack 20, having sides 23, top 25; conductive member 80, having conductive film or pouch 85; and discharge tab 100.

Figure 1D:
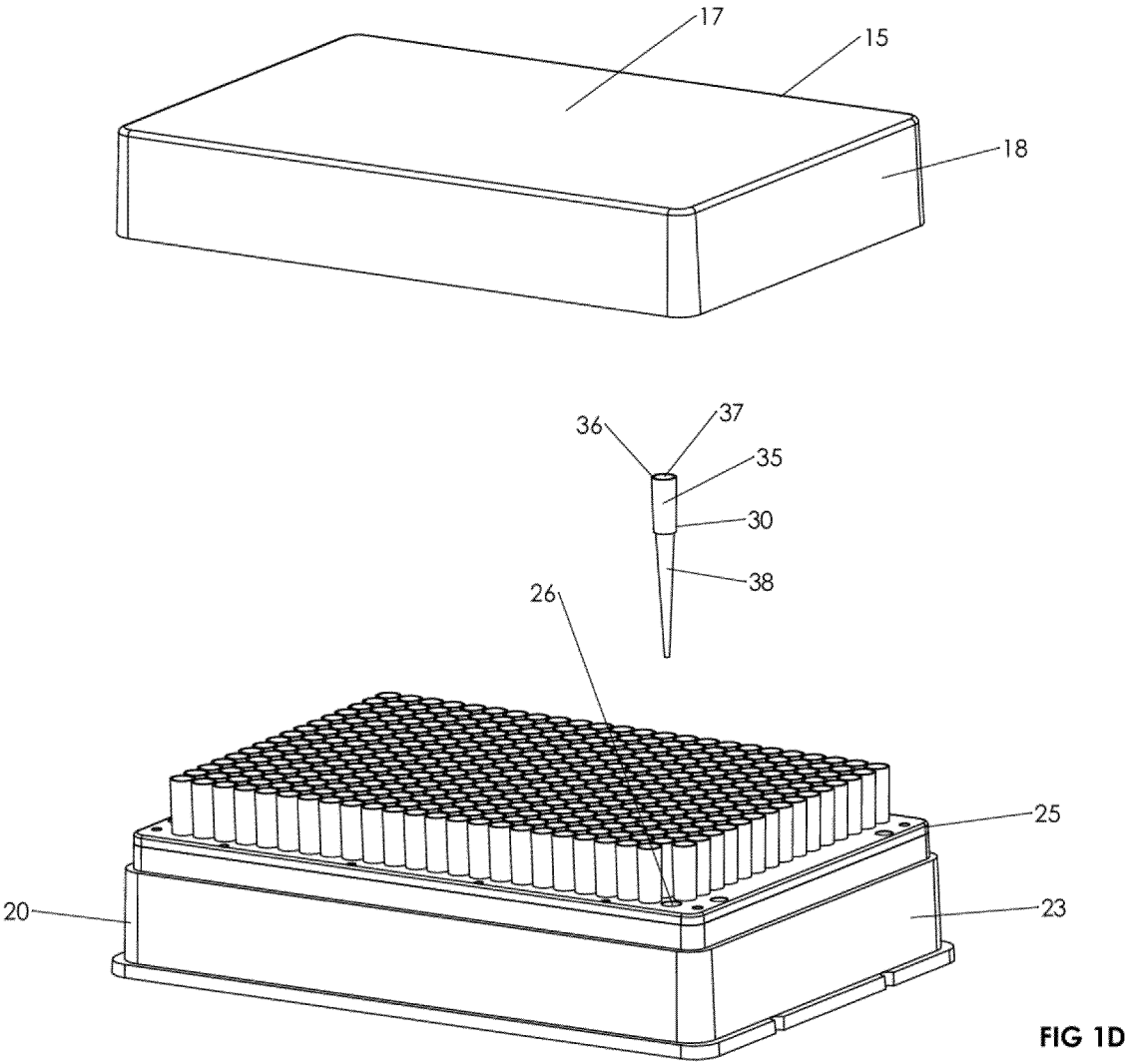
FIG. 1D is an exploded perspective view of a conventional pipette tip tray.

FIG. 1D is an exploded perspective view of a conventional pipette tip tray. Shown in FIG. 1D are lid 15, having a top 17 and sides 18; rack 20, having sides 23, top 25 and apertures 26 in the top; and tips 30, each having a proximal section 35, a distal section 38, an aperture 37 in the proximal section and a top edge 36 surrounding the aperture 37. Tips 30 are disposed in apertures 26 of the rack top 25, where a lip formed between the junction of the proximal section 35 and distal section 38 rests on the rack top 25.

Figure 1E:
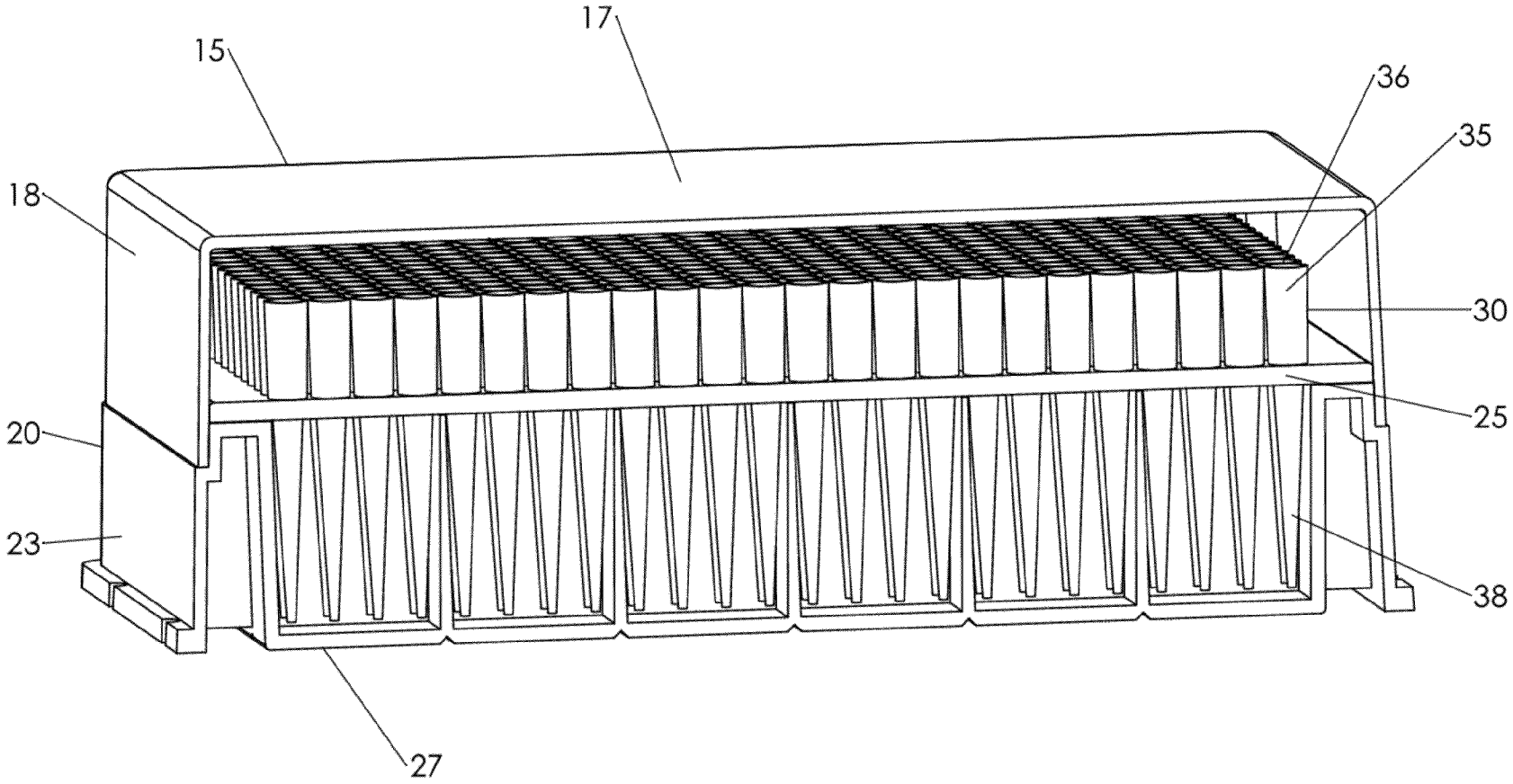
FIG. 1E is a perspective view in partial section of a conventional pipette tip tray.

FIG. 1E is an elevation view in partial section of a conventional pipette tip tray. Shown in FIG. 1E are bottom 27 and top 25 portions of rack 20 in the conventional pipette tip tray. Top 25 of rack 20 (e.g., sometimes referred to as a "card" herein) is a component manufactured separately from the portion of the rack having sides 23 and bottom 27 (e.g., sometimes referred to as a "rack bottom"). The card is affixed to the rack bottom in the embodiment shown in FIG. 1B, and sometimes is affixed via a snap fit. In some embodiments, pipette tip trays as described herein also include the features described for a conventional pipette tip tray configured as shown in FIGS. 1D and 1E.

Figures 2C, 2D:
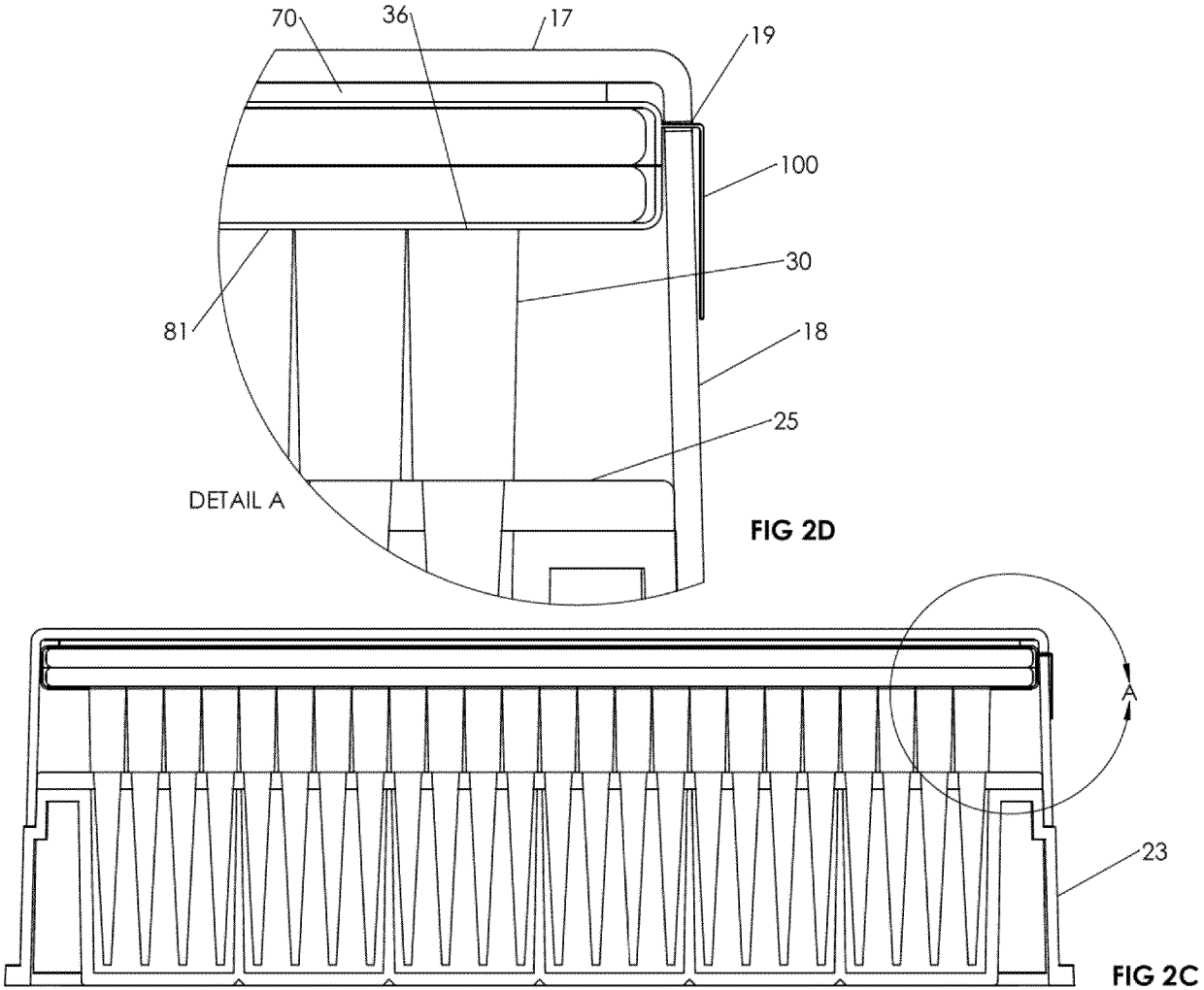
FIG. 2C is a side view in partial section of a pipette tip tray embodiment with a side discharge tab as described herein.
FIG. 2D is an enlarged view of detail area A in FIG. 2C.

FIGS. 2A and 2C show an elevation view in partial section of pipette tip tray embodiments described herein. FIGS. 2B and 2D are enlarged views of detail area A in FIGS. 2A and 2C. Shown in FIGS. 2A-2D are inner surface of lid top 17 attached to pouch 85 (not shown) by adhesive 70. Tab 100 is in effective connection with pouch 85 (not shown) at junction 101 and extends through aperture 19 in side 18 of lid 15. Bottom surface 81 of pouch 85 is in connection with the top edge 36 of each pipette tip and applies downward pressure to each of the tips, thereby substantially immobilizing the tips in the pipette tip tray. In FIGS. 2A and 2B, tab 100 extends through aperture 19 in lid top 17, and in FIGS. 2C and 2D, tab 100 extends through aperture 19 in side 18 of lid 15. In some embodiments (not shown), tab 100 can extend through lid top 17 and/or lid side 18.

Figure 3A:
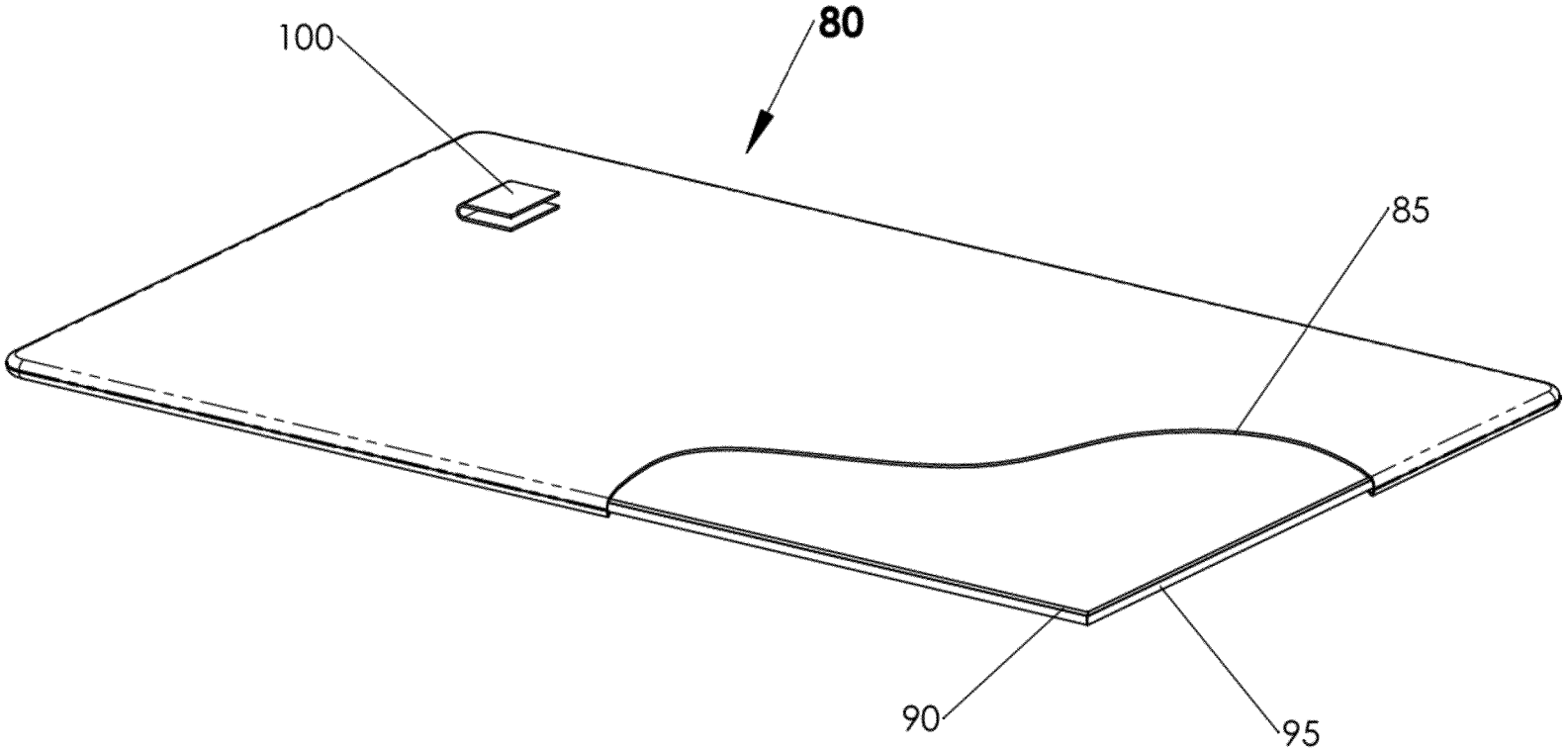
FIGS. 3A-3F illustrate pouch embodiments, where
Figure 3C:
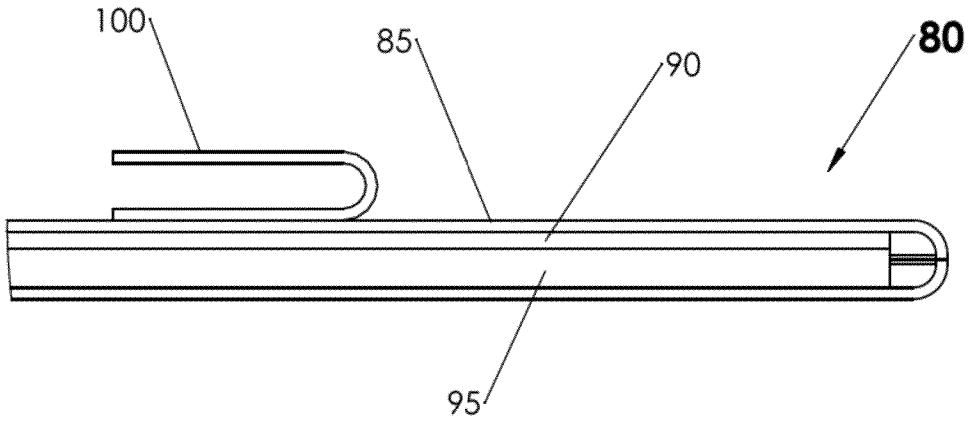
Figure 3B:
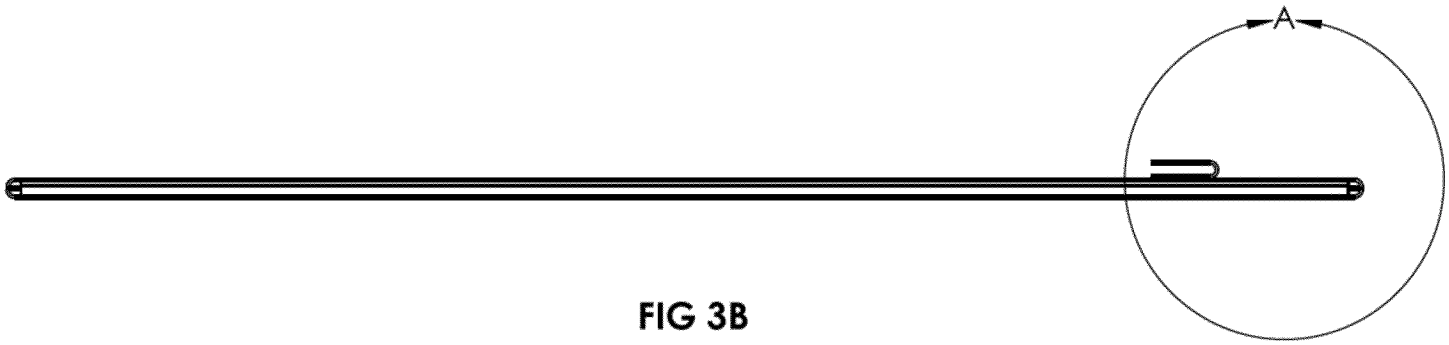
Figure 3D:
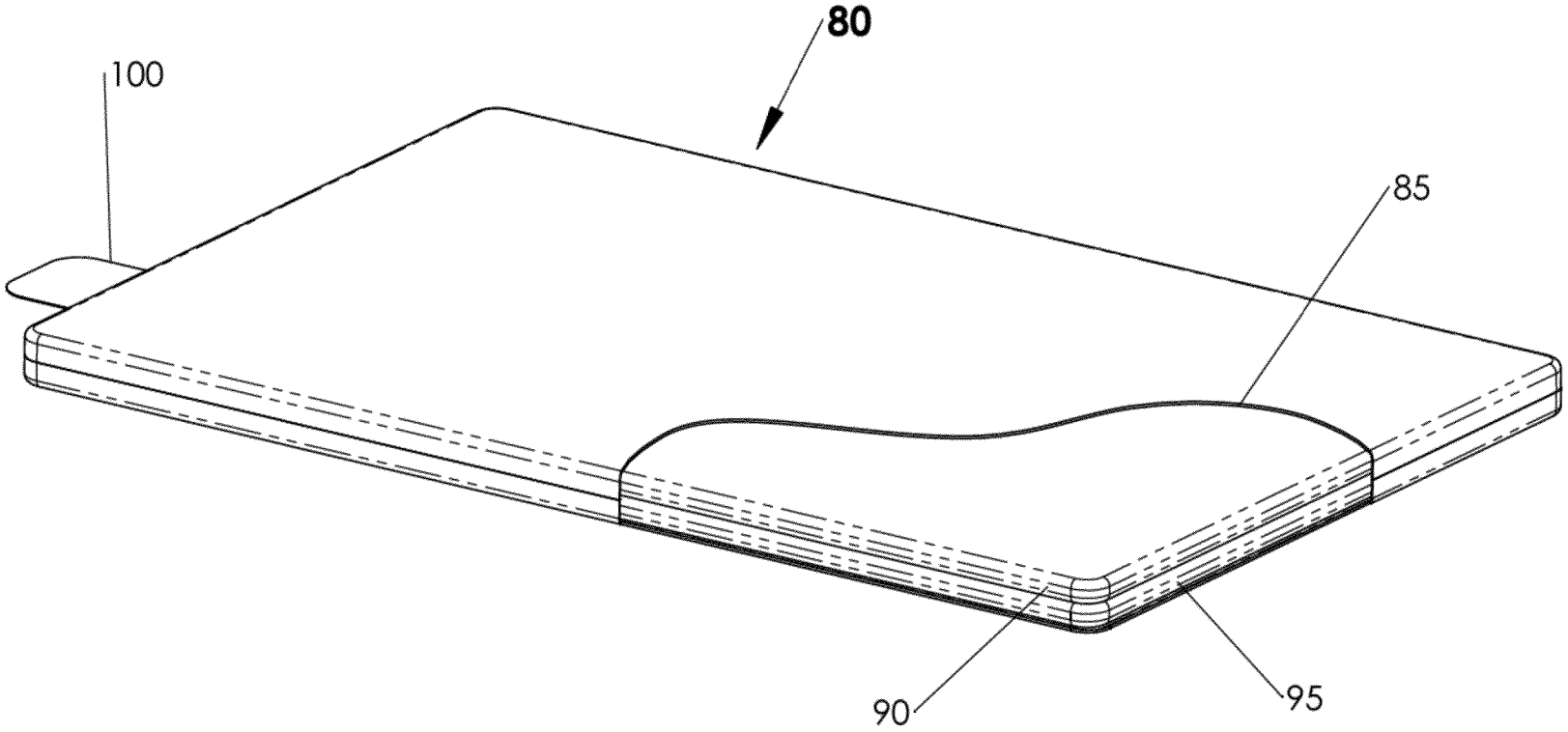
Figure 3F:
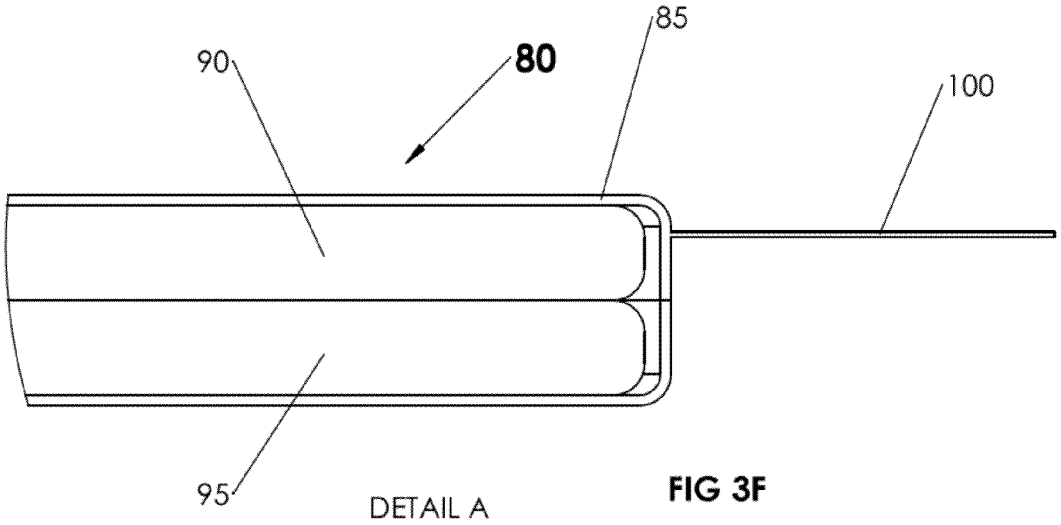
Figure 3E:
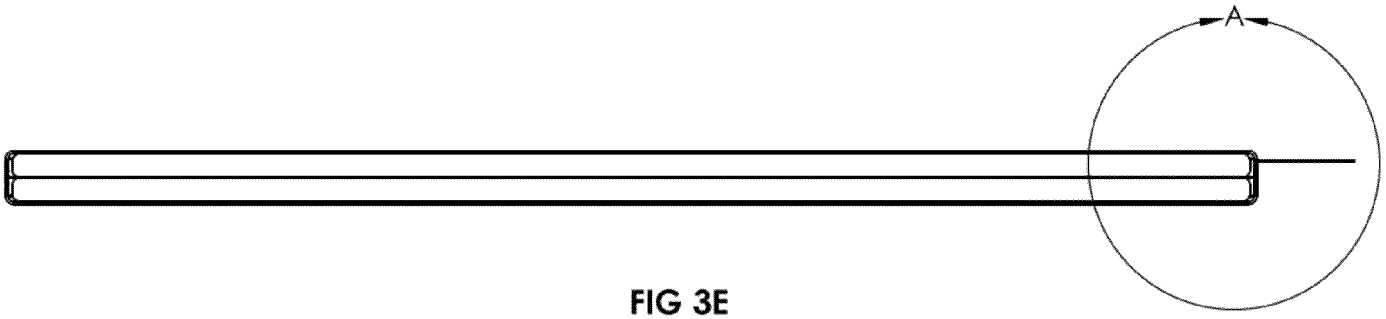

FIG. 3A-3F illustrate pouch embodiments. FIGS. 3A and 3D are perspective views, partially cut away, of conductive member 80, pouch 85, pliant member 95, support member 90 and tab 100. FIGS. 3B, 3C, 3E and 3F are elevation views in section and shown is conductive member 80, pouch 85, pliant member 95, support member 90 and tab 100, where FIGS. 3C and 3F are enlarged views of detail area A in FIGS. 3B and 3E. As illustrated in FIGS. 3A-3F, pliant member 95 is located below support member 90, and in some embodiments, the pliant member is located above the support member (not shown).

Certain non-limiting examples of embodiments are set forth hereafter.

A1. A pipette tip tray comprising rack, lid and pipette tip components, wherein:

the rack comprises four sides and a top;

the top comprises apertures and the pipette tips are positioned in the apertures;

the lid is in connection with the rack;

the pipette tips are in contact with an electrically conductive member;

the electrically conductive member is in effective communication with the pipette tip tray exterior; and the pipette tips are substantially immobilized.

A2. The pipette tip tray of embodiment A1, wherein the lid comprises a pliant material in effective contact with the pipette tips.

A3. The pipette tip tray of embodiment A2, wherein the pliant material is in effective contact with the electrically conductive member.

A4. The pipette tip tray of embodiment A2, wherein the electrically conductive member comprises the pliant material.

A5. The pipette tip tray of any one of embodiments A1-A4, wherein the rack comprises the electrically conductive member.

A6. The pipette tip tray of any one of embodiments A1-A5, wherein the rack comprises a pliant material in effective connection with the pipette tips.

A7. The pipette tip tray of embodiment A6, wherein the pliant material is in effective contact with the electrically conductive member.

A8. The pipette tip tray of embodiment A6, wherein the electrically conductive member comprises the pliant material.

A9. The pipette tip tray of embodiment A1, wherein the rack and the lid comprise an electrically conductive member.

A10. The pipette tip tray of any one of embodiment A1 or A9, wherein the rack and the lid comprise a pliant material in effective connection with the pipette tips.

A11. The pipette tip tray of embodiment A10, wherein the pliant material is in effective contact with the electrically conductive member.

A12. The pipette tip tray of embodiment A10, wherein the electrically conductive member comprises the pliant material.

A13. The pipette tip tray of any one of embodiments A1-A12, wherein the electrically conductive member comprises a metal.

A14. The pipette tip tray of embodiment A13, wherein the metal comprises an element selected from the group consisting of palladium, platinum, gold, silver, copper, aluminum, nickel and combinations thereof.

A15. The pipette tip tray of any one of embodiments A1-A14, wherein the electrically conductive member comprises a polymer.

A16. The pipette tip tray of any one of embodiments A1-A15, wherein the electrically conductive member comprises a foam.

A17. The pipette tray of any one of embodiments A1-A16, wherein the electrically conductive member comprises a foil.

A18. The pipette tip tray of any one of embodiments A1-A17, wherein a portion of the electrically conductive member is in contact with an exterior surface of the lid.

A19. The pipette tip tray of any one of embodiments A1-A17, wherein a portion of the electrically conductive member is in contact with an exterior surface of the rack.

A20. The pipette tip tray of any one of embodiments A1-A17, wherein a portion of the electrically conductive member is in contact with an exterior surface of the lid and a portion of the electrically conductive member is in contact with an exterior surface of the rack.

A21. The pipette tip tray of any one of embodiments A1-A20, wherein the lid comprises an aperture that exposes a portion of the electrically conductive member.

A22. The pipette tip tray of any one of embodiments A1-A20, wherein the rack comprises an aperture that exposes a portion of the electrically conductive member.

A23. The pipette tip tray of any one of embodiments A1-A20, wherein the rack and the lid comprise an aperture that exposes a portion of the electrically conductive member.

A24. The pipette tip tray of any one of embodiments A1-A23, wherein a portion of the electrically conductive member extends to the exterior of the pipette tip tray.

A25. The pipette tip tray of embodiment A24, wherein the portion extends through the lid.

A26. The pipette tip tray of embodiment A24 of A25, wherein the portion is in effective connection with an exterior surface of the lid.

A27. The pipette tip tray of embodiment A24, wherein the portion extends through the rack.

A28. The pipette tip tray of embodiment A24 or A27, wherein the portion is in connection with an exterior surface of the rack.

A29. The pipette tip tray of any one of embodiments A1-A28, wherein the pipette tips are substantially immobilized along the longitudinal axis of the pipette tips.

A30. The pipette tip tray of embodiment A29, wherein the pipette tips can be displaced along the longitudinal axis between about 0 millimeters to about 0.01 millimeters.

A31. The pipette tip tray of any one of embodiments A1-A30, wherein the pipette tips are substantially immobilized along a horizontal plane of the pipette tips.

A32. The pipette tip tray of any one of embodiments A1-A31, wherein the walls of the apertures are tapered inwards towards the bottom of the rack.

A34. The pipette tip tray of embodiment A31 or A32, wherein the pipette tips can be displaced along a horizontal plane between about 0 millimeters to about 0.01 millimeters.

A35. The pipette tip tray of any one of embodiments A1-A34, wherein the pipette tips are substantially immobilized along (i) the longitudinal axis, and (ii) a horizontal plane, of the pipette tips.

A36. The pipette tip tray of any one of embodiments A1-A35, wherein the rack comprises a bottom.

A37. The pipette tip tray of any one of embodiments A1-A36, wherein the pipette tips comprise polypropylene.

A38. The pipette tip tray of any one of embodiments A1-A37, wherein the rack comprises polypropylene.

A39. The pipette tip tray of any one of embodiments A1-A38, wherein the lid comprises polypropylene.

A40. The pipette tip tray of embodiment A1, wherein the electrically conductive material comprises an electrically conductive film.

A41. The pipette tip tray of embodiment A40, wherein the film forms a pouch.

A42. The pipette tip tray of embodiment A41, wherein the pouch comprises an interior space and a pliant material within the interior space.

A43. The pipette tip tray of embodiment A42, wherein the pouch comprises a support material within the interior space.

A44. The pipette tip tray of any one or embodiments A41-A43, wherein the pouch comprises no openings.

A45. The pipette tip tray of any one or embodiments A41-A43, wherein the pouch is formed from a tube-shaped structure of the film having two openings.

A46. The pipette tip tray of embodiment A45, wherein the openings of the structure are sealed.

A47. The pipette tip tray of embodiment A46, wherein the openings are sealed by an impulse heat sealer.

A48. The pipette tip tray of any one of embodiments A41-A47, wherein the pouch comprises a tab.

A49. The pipette tip tray of embodiment A48, wherein the tab is formed from the same film as the pouch and is coextensive with the pouch.

A50. The pipette tip tray of embodiment A48 or A49, wherein the tab is exposed to the tray exterior.

A51. The pipette tip tray of embodiment A50, wherein the tab protrudes through an aperture in the pipette tip tray.

A52. The pipette tip tray of embodiment A51, wherein the aperture is in the lid.

A53. The pipette tip tray of any one of embodiments A50-A52, wherein the tab is in effective contact with an exterior surface of the pipette tip tray.

A54. The pipette tip tray of embodiment A53, wherein the tab is affixed to an exterior surface of the lid.

A55. The pipette tip tray of embodiment A53, wherein the tab is in effective contact with an exterior surface of the pipette tip tray via an adhesive.

A56. The pipette tip tray of embodiment A54 or A55, wherein the tab is in effective contact with an electrically conductive support.

A57. The pipette tip tray of embodiment A56, wherein the electrically conductive support is a label.

A58. The pipette tip tray of embodiment A55, wherein the adhesive is electrically conductive.

A59. The pipette tip tray of any one or embodiments A40-A58, wherein the film comprises about 10% or more carbon by weight.

A60. The pipette tip tray of any one or embodiments A40-A59, wherein the film is extruded.

A61. The pipette tip tray of any one or embodiments A40-A59, wherein the film is blown.

A62. The pipette tip tray of any one or embodiments A40-A59, wherein the film is extruded and blown.

A63. The pipette tip tray of any one of embodiments A41-A62, wherein the pouch is in effective contact with an interior surface of the lid.

A64. The pipette tip tray of embodiments A63, wherein the pouch is affixed to an interior surface of the lid by an adhesive.

B1. A pipette tip tray comprising rack, lid and pipette tip components, wherein:

the rack comprises four sides and a top;

the top comprises apertures and the pipette tips are positioned in the apertures;

the lid is in connection with the rack;

the lid comprises (i) an electrically conductive member in effective communication with the pipette tip tray exterior, and (ii) a pliant member between the electrically conductive member and an interior surface of the lid;

the electrically conductive member is in contact with the pipette tips; and the pliant member is deformed and applies pressure to the top of each of the pipette tips;

whereby the pipette tips are substantially immobilized.

C1. A pipette tip tray comprising rack, lid and pipette tip components, wherein:

the rack comprises four sides and a top;

the top comprises apertures and the pipette tips are positioned in the apertures;

the lid is in connection with the rack;

the lid comprises an electrically conductive and pliant member in effective communication with the pipette tip tray exterior and in effective contact with an interior surface of the lid;

the electrically conductive and pliant member is in contact with the pipette tips; and the electrically conductive and pliant member is deformed and applies pressure to the top of each of the pipette tips; whereby the pipette tips are substantially immobilized.

D1. A pipette tip tray comprising rack and lid components, wherein:

the rack comprises four sides and a top;

the top comprises apertures shaped to receive pipette tips;

the lid comprises an electrically conductive member that can contact pipette tips when they are positioned in the apertures;

the electrically conductive member is in effective communication with the pipette tip tray exterior; and the lid comprises a pliant material in effective contact with pipette tips when they are positioned in the apertures.

D2. The pipette tip tray of embodiment D1, wherein there are no pipette tips positioned in the apertures.

E1. A method for discharging static electricity from pipette tips in a pipette tip tray, which comprises:

(a) providing a pipette tip tray comprising rack, lid and pipette tip components, wherein:

the rack comprises four sides and a top;

the top comprises apertures and the pipette tips are positioned in the apertures;

the lid is in connection with the rack;

the pipette tips are in contact with an electrically conductive member;

the electrically conductive member is in effective communication with the pipette tip tray exterior; and the pipette tips are substantially immobilized; and (b) contacting the electrically conductive member with an object at the pipette tip tray exterior, whereby the static electricity of the pipette tips in the pipette tip tray is discharged to the object.

E2. The method of embodiment E1, wherein the object is a human body.

F1. A pipette tip tray comprising rack, lid and pipette tip components, wherein:

(a) the rack comprises four sides and a top;

(b) the top comprises apertures and the pipette tips are positioned in the apertures;

(c) the lid is in connection with the rack;

(d) the lid comprises an electrically conductive material;

(e) the electrically conductive material is in effective communication with the pipette tip tray exterior; and (f) the pipette tips are substantially immobilized.

F2. The pipette tip tray of embodiment F1, wherein a portion of the bottom surface of the lid is in contact with substantially all of the pipette tips.

F3. The pipette tip tray of embodiment F1 or F2, wherein the static charge in pipette tips in contact with the lower surface of the lid can discharge through the thickness of the lid to the top surface of the lid.

F4. The pipette tip tray of any one of embodiments F1-F3, wherein the lid comprises two or more electrically conductive materials.

F5. The pipette tip tray of any one of embodiments F1-F4, wherein the lid consists essentially of an electrically conductive material.

F6. The pipette tip tray of any one of embodiments F1-F5, wherein the lid comprises about 75% or more of an electrically conductive material.

F7. The pipette tip tray of any one of embodiments F1-F6, wherein the lid consists of an electrically conductive material.

F8. The pipette tip tray of any one of embodiments F1-F7, wherein a rack component comprises an electrically conductive material.

F9. The pipette tip tray of embodiment F8, wherein the rack component is a card.

G1. A pipette tip tray comprising a rack, lid and pipette tip components, wherein:

(a) the rack comprises four sides and a top;

(b) the top comprises apertures into which pipette tips can be positioned;

(c) the lid is in connection with the rack;

(d) the lid comprises an electrically conductive material;

(e) the electrically conductive material is in effective communication with the pipette tip tray exterior; and (f) the pipette tips can be substantially immobilized against a bottom surface of the lid.

H1. A method for discharging static electricity from pipette tips in a pipette tip tray, which comprises:

(a) providing a pipette tip tray comprising rack, lid and pipette tip components, wherein: (i) the rack comprises four sides and a top; (ii) the top comprises apertures and the pipette tips are positioned in the apertures; (iii) the lid is in connection with the rack; (iv) the lid comprises an electrically conductive material; (v) the electrically conductive material is in effective communication with the pipette tip tray exterior; and (vi) the pipette tips are substantially immobilized; and (b) contacting the electrically conductive member with an object at the pipette tip tray exterior, whereby the static electricity of the pipette tips in the pipette tip tray is discharged to the object.

I1. A method for discharging static electricity from pipette tips in a pipette tip tray, which comprises:

(a) providing a pipette tip tray comprising rack, lid and pipette tip components, wherein:

the rack comprises four sides and a top;

the top comprises apertures and the pipette tips are positioned in the apertures;

the lid is in connection with the rack;

the pipette tips are in contact with an electrically conductive member;

the electrically conductive member is in effective communication with the pipette tip tray exterior; and the pipette tips are substantially immobilized; and (b) contacting the electrically conductive member with a grounded object at the pipette tip tray exterior, wherein the grounded object is a human body, whereby the static electricity of the pipette tips in the pipette tip tray is discharged to the object.

J1. The pipette tip tray of anyone of embodiments B1-I1, wherein the rack comprises a bottom.

The entirety of each patent, patent application, publication and document referenced herein hereby is incorporated by reference. Citation of the above patents, patent applications, publications and documents is not an admission that any of the foregoing is pertinent prior art, nor does it constitute any admission as to the contents or date of these publications or documents.

Modifications may be made to the foregoing without departing from the basic aspects of the technology. Although the technology has been described in substantial detail with reference to one or more specific embodiments, those of ordinary skill in the art will recognize that changes may be made to the embodiments specifically disclosed in this application, yet these modifications and improvements are within the scope and spirit of the technology.

The technology illustratively described herein suitably may be practiced in the absence of any element(s) not specifically disclosed herein. Thus, for example, in each instance herein any of the terms "comprising," "consisting essentially of," and "consisting of" may be replaced with either of the other two terms. The terms and expressions which have been employed are used as terms of description and not of limitation, and use of such terms and expressions do not exclude any equivalents of the features shown and described or portions thereof, and various modifications are possible within the scope of the technology claimed. The term "a" or "an" can refer to one of or a plurality of the elements it modifies (e.g., "a reagent" can mean one or more reagents) unless it is contextually clear either one of the elements or more than one of the elements is described. The term "about" as used herein refers to a value within 10% of the underlying parameter (i.e., plus or minus 10%), and use of the term "about" at the beginning of a string of values modifies each of the values (i.e., "about 1, 2 and 3" is about 1, about 2 and about 3). For example, a weight of "about 100 grams" can include weights between 90 grams and 110 grams. Thus, it should be understood that although the present technology has been specifically disclosed by representative embodiments and optional features, modification and variation of the concepts herein disclosed may be resorted to by those skilled in the art, and such modifications and variations are considered within the scope of this technology.

Embodiments of the technology are set forth in the claims that follow.

What is claimed is:

1. A pipette tip tray, comprising:

a rack comprising four sides and a top, which top comprises apertures;

a plurality of pipette tips positioned in the apertures, each of which pipette tips comprise a top surface and which pipette tips are substantially immobilized;

a lid in connection with the rack, which lid comprises a top comprising an inner surface; and an electrically conductive member residing between the top surfaces of each of the pipette tips and the inner surface of the lid, which conductive member is in effective communication with the an exterior surface of the rack or the lid.

2. The pipette tip tray of claim 1, wherein a top surface of each of the pipette tips is in effective communication with the inner surface of the top of the lid, thereby substantially immobilizing the pipette tips.

3. The pipette tip tray of claim 1, wherein the lid comprises an electrically conductive material.

4. The pipette tip tray of claim 1, wherein the electrically conductive member is in effective communication with an interior surface of the lid.

5. The pipette tip tray of claim 1, wherein the electrically conductive member comprises a pliant member in effective communication with the top of each of the pipette tips.

6. The pipette tip tray of claim 5, wherein the pliant member is deformed when in contact with the top of each of the pipette tips.

7. The pipette tip tray of claim 2, wherein the pipette tips are substantially immobilized along a longitudinal axis of the pipette tips.

8. The pipette tip tray of claim 2, wherein the pipette tips are substantially immobilized along a horizontal plane of the pipette tips.

9. The pipette tip tray of claim 1, comprising a tab in effective communication with the electrically conductive member.

10. The pipette tip tray of claim 9, wherein at least a portion of the tab is located on the rack or lid exterior.

11. The pipette tip tray of claim 1, wherein the electrically conductive member comprises a metal or a foil.

12. The pipette tip tray of claim 9, wherein the tab comprises a metal or a foil.

13. The pipette tip tray of claim 9, wherein the tab is in effective communication with an exterior surface of the lid.

14. The pipette tip tray of claim 1, wherein the rack comprises a bottom.

* * * * *